US011859382B2

(12) United States Patent
Van Vlerken

(10) Patent No.: US 11,859,382 B2
(45) Date of Patent: Jan. 2, 2024

(54) FORMWORK FOR FOUNDATION CONSTRUCTION

(71) Applicant: QUICKSET LIMITED, Auckland (NZ)

(72) Inventor: Carl Anthony Van Vlerken, Coatesville (NZ)

(73) Assignee: QUICKSET LIMITED, Silverdale (NZ)

( * ) Notice: Subject to any disclaimer, the term of this patent is extended or adjusted under 35 U.S.C. 154(b) by 146 days.

(21) Appl. No.: 17/431,339

(22) PCT Filed: Feb. 17, 2020

(86) PCT No.: PCT/IB2020/051295
§ 371 (c)(1),
(2) Date: Aug. 16, 2021

(87) PCT Pub. No.: WO2020/165877
PCT Pub. Date: Aug. 20, 2020

(65) Prior Publication Data

US 2022/0098857 A1 Mar. 31, 2022

(30) Foreign Application Priority Data

Feb. 15, 2019 (NZ) ..... 750758

(51) Int. Cl.
*E04B 5/38* (2006.01)
*E04G 13/00* (2006.01)
(Continued)

(52) U.S. Cl.
CPC ..... *E04B 5/38* (2013.01); *E04G 13/00* (2013.01); *E04G 17/14* (2013.01); *E04G 21/185* (2013.01); *E04B 2005/322* (2013.01)

(58) Field of Classification Search
CPC ..... E04B 5/38; E04B 2005/322; E04G 13/00; E04G 17/14; E04G 21/185
See application file for complete search history.

(56) References Cited

U.S. PATENT DOCUMENTS 5,174,083 A 12/1992 Mussell
5,553,430 A 9/1996 Majnaric et al.
(Continued)

FOREIGN PATENT DOCUMENTS

AU 591816 4/1988
DE 10102660 A1 * 7/2002 ..... E04B 5/32
(Continued)

OTHER PUBLICATIONS

International Search Report.
International Preliminary Report.

*Primary Examiner* — Christine T Cajilig
(74) *Attorney, Agent, or Firm* — Jacobson Holman PLLC

(57) ABSTRACT

An internally braced permanent formwork for concrete foundation construction is provided in order to achieve a quick and simple assembly. The formwork comprises a base member laid on the ground having a perimeter recess on an upper surface for receiving components of the formwork. One or more permanent outer boards forming an outer periphery of the foundation are provided and coupled to a plurality of spaced internal bracing components to prevent collapse under the pressure of wet concrete.

21 Claims, 18 Drawing Sheets

(51) Int. Cl.

| | |
|---|---|
| ***E04G 17/14*** | (2006.01) |
| ***E04G 21/18*** | (2006.01) |
| ***E04B 5/32*** | (2006.01) |

(56) References Cited

U.S. PATENT DOCUMENTS

| | | | | |
|---|---|---|---|---|
| 5,803,669 | A * | 9/1998 | Bullard | E04B 2/40 405/257 |
| 6,540,201 | B1 * | 4/2003 | Gagnon | B28B 7/0014 249/189 |
| 7,114,695 | B2 | 10/2006 | DeLoach, Sr. | |
| 8,584,427 | B2 | 11/2013 | Compton | |
| 9,850,658 | B2 | 12/2017 | Ordaz | |
| 10,428,484 | B2 * | 10/2019 | Delorme | E02D 27/02 |
| 11,193,251 | B2 * | 12/2021 | Delorme | E02D 27/02 |
| 2002/0092249 | A1 | 7/2002 | Yin | |
| 2009/0255199 | A1 * | 10/2009 | Lonsdale | E04B 5/32 52/309.1 |
| 2015/0167295 | A1 | 6/2015 | Baader | |
| 2015/0275531 | A1 | 10/2015 | Ordaz | |
| 2016/0115698 | A1 | 4/2016 | Pardi | |

FOREIGN PATENT DOCUMENTS

| | | | |
|---|---|---|---|
| DE | 20 2007 011 315 | | 11/2007 |
| EP | 0048468 | A1 * | 3/1982 |
| EP | 20 80 837 | | 7/2009 |
| EP | 2 365 150 | | 9/2011 |
| EP | 2 439 351 | | 4/2012 |
| GB | 2 254 099 | | 9/1992 |
| KR | 2015/0004996 | | 1/2015 |
| WO | 2007/087650 | | 8/2007 |
| WO | 2012/053021 | | 4/2012 |
| WO | 2017/188721 | | 11/2017 |

* cited by examiner

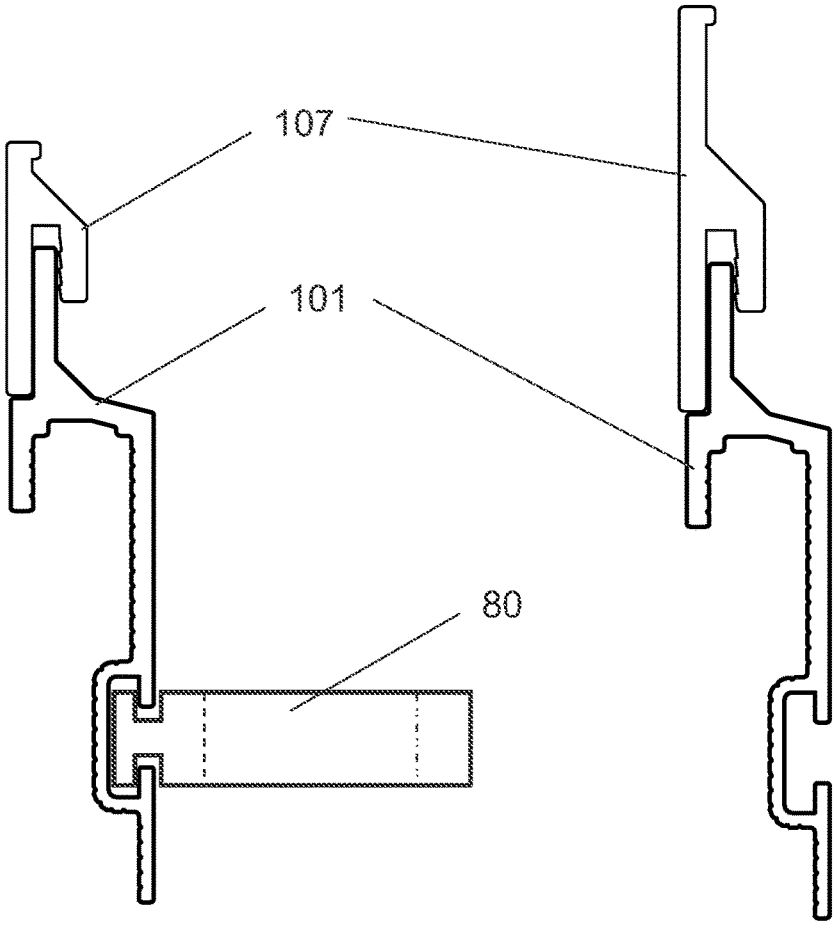
FIG.23A
FIG.23B
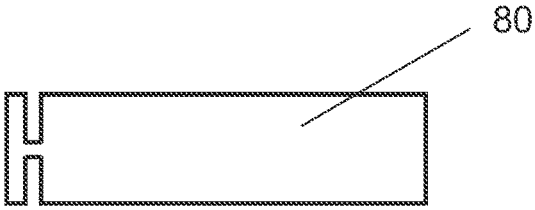
FIG.24A
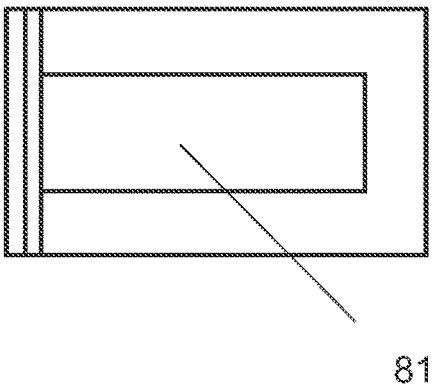
FIG.24B

FORMWORK FOR FOUNDATION CONSTRUCTION

FIELD OF THE INVENTION

The present invention relates to an improved formwork and method for foundation construction. More particularly, but not exclusively, it relates to an internally braced permanent formwork and method for foundation construction.

BACKGROUND OF THE INVENTION

Concrete slab foundations are important in many building projects as the concrete foundation supports the building structure.

Typically, temporary formwork boards are used to define the slab foundation boundary into which concrete is poured and cured. To withstand the pressure of wet concrete, and ensure the formwork stays upright and in place, external formwork stakes secured to the ground may be used. The formwork boards generally remain in place until the concrete has hardened (at least 24 hours) and may then be removed to be reused again or discarded.

The process for forming concrete foundation using traditional temporary formwork boards is a labour intensive process. Workers often need to make multiple trips to a construction site for each concrete foundation constructed. A time-consuming foundation construction process is costly and may hold up other construction work which takes place on-site. A lengthy foundation construction process may be undesirable especially where parts of construction work are weather dependent.

Forming a concrete slab foundation in a timely and cost-effective manner may be desirable. Therefore, formwork which is simple and efficient to set-up may be particularly useful. A strong concrete foundation fit for purpose is also important.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

For the purpose of this specification, where method steps are described in sequence, the sequence does not necessarily mean that the steps are to be chronologically ordered in that sequence, unless there is no other logical manner of interpreting the sequence.

It is an object of the present invention to provide an improved formwork for foundation construction which overcomes or at least partially ameliorates some of the above-mentioned disadvantages or which at least provides the public with a useful choice.

BRIEF DESCRIPTION OF THE INVENTION

According to a first aspect the invention broadly comprises an internally braced permanent formwork for concrete slab foundation construction comprising:

a base sheet member directly or indirectly having a perimeter recess on an upper surface of the base member configured to receive components of the formwork, one or more permanent outer boards to receive and contain concrete for a concrete slab foundation and forming an outermost peripheral wall of the slab foundation, a plurality of internal bracing members supporting the outer boards integrated internally into the slab foundation, wherein the one or more permanent outer boards are coupled to the internal bracing members at an upper region of the outer boards to provide support against tipping, and wherein the one or more permanent outer boards are connected to the base sheet member so that a lower edge of the outer board engages in the perimeter recess.

According to another aspect the perimeter recess extends substantially the length of the insulated base sheet member.

According to another aspect the permanent outer boards are mechanically coupled to the internal components.

According to another aspect an inner recess directly or indirectly on an upper surface of the base sheet member is configured to receive internal components of the formwork.

According to another aspect a first lower portion of the internal bracing member fits into the inner recess of the base sheet member to securely support the internal bracing member.

According to another aspect the inner recess comprises a complementary hook profile for coupling the first lower portion of the internal bracing member to the base sheet member.

According to another aspect a second lower portion of the internal bracing member fits into the perimeter recess of the base sheet member.

According to another aspect the invention broadly comprises one or more void formers.

According to another aspect the outer board is coupled to the void formers.

According to another aspect the internal bracing member and the outer board have complementary features configured to engage and connect the components.

According to another aspect the complementary features are complementary protrusions and apertures.

According to another aspect the complementary features form a dovetail joint, or a key and key slot joint.

According to another aspect the perimeter recess and/or the inner recess receives components of the formwork directly.

According to another aspect the perimeter recess and/or the inner recess receives components of the formwork indirectly.

According to another aspect the formwork comprises one or more cradle strips inserted in the perimeter recess and/or inner recess to receive components of the formwork in the base sheet member indirectly, further comprising an inner slot configured to receive one or more components of the formwork.

According to another aspect the inner slot comprises a profile complimentary to the component which it receives.

According to another aspect a single perimeter recess and/or inner recess receives two or more components of the formwork.

According to another aspect both the outer board and the internal bracing member are received in the perimeter recess on the base sheet member.

According to another aspect the cradle strip comprises stepped inner slot receiving two or more components, the inner slot having a first depth region to receive a first component and a second depth region to receive a second component.

According to another aspect the perimeter recess is a slot having a lip configured to secure the outer board and provide extra resistance against wet concrete.

According to another aspect a shelf member, or discrete shelf members configured to mechanically couple the outer board to the internal bracing member.

According to another aspect the shelf member(s) comprises one or more apertures to receive a protruding region of the internal bracing member.

According to another aspect the internal bracing members are hollow members comprising a hollowed out centre region to allow concrete to flow through.

According to another aspect the internal bracing members are generally flat.

According to another aspect the internal bracing members comprise a first leg configured to be inserted into the perimeter recess and a second leg configured to be inserted into the inner recess spaced inward from the perimeter recess.

According to another aspect the internal bracing members comprise rebar chairs configured to receive rebar.

According to another aspect the base sheet member is located at least around the perimeter of the slab.

According to another aspect further comprising a footing region and the base sheet member spans at least across the footing region.

According to another aspect rebar to reinforce the concrete in the footing region.

According to another aspect the invention broadly comprises a mesh reinforcement supported on an upper region of the internal bracing members within the formwork.

According to another aspect a lower edge of the void former directly or indirectly engages with the inner recess.

According to another aspect the invention broadly comprises intermediate boards to form a stepped foot region.

According to another aspect the base sheet member is a sheet of insulating material.

According to another aspect the action of mechanically coupling components is one or more of the actions of:

i. Inserting,
ii. Hooking,
iii. Sliding,
iv. Wedging,
v. Interlocking.

According to another aspect the outer board is formed from one or more of the following materials:

i. PVC board,
ii. Fibreglass
iii. Polymers,
iv. Cement board.

According to another aspect the outer board is formed from one or more of the following materials:

i. Polystyrene,
ii. Foam,
iii. Rubber.

According to another aspect the cradle strip comprises a stiffer material than the base sheet member.

According to another aspect the permanent formwork is formed on a ground surface.

According to another aspect the invention broadly comprises a method of constructing concrete slab foundation using an internally braced formwork comprising:

providing a base sheet member having a perimeter recess formed directly or indirectly on an upper surface of the base sheet member configured to receive components of the formwork, inserting one or more permanent outer boards into the perimeter recess of the base sheet member so that a lower edge of the outer board engages in the perimeter recess, the permanent outer boards to receive and contain concrete for a concrete slab foundation an forming an outermost peripheral wall of the slab foundation, providing a plurality of internal bracing members to support the outer boards, coupling the one or more permanent outer boards to the internal bracing members at an upper region of the outer board to provide support against tipping, the one or more permanent outer boards being integrated internally into the slab foundation, and pouring concrete into a space defined by the outer boards.

According to another aspect one or more components of the formwork are prefabricated off-site.

According to another aspect prefabricated modules of the formwork are preassembled and transported onsite.

According to another aspect the prefabricated modules include at least the outer boards, base sheet member and internal bracing members.

According to another aspect the perimeter recess extends substantially the length of the base sheet member.

According to another aspect forming an inner recess directly or indirectly on an upper surface of the base member configured to receive internal components of the formwork.

According to another aspect the method further comprises fitting a first lower portion of the internal bracing member into the inner recess of the base sheet member to securely support the internal bracing member.

According to another aspect the inner recess comprises a complementary hook profile for coupling the first lower portion of the internal bracing member to the base sheet member.

According to another aspect mechanically coupling the components of the internally braced formwork together on-site before the concrete is poured.

According to another aspect fitting complementary features of the internal bracing member and the outer board together.

According to another aspect the complementary features are complementary protrusions and apertures.

According to another aspect fitting a lower portion of the internal bracing member into the perimeter recess and/or inner recess of the insulated base sheet member.

According to another aspect the perimeter recess and/or inner recess are slots.

According to another aspect the perimeter recess and/or inner recess are formed by routing grooves onto the upper surface of the base sheet member.

According to another aspect the base sheet member is manufactured with the perimeter recess and/or inner recess.

According to another aspect internal components of the formwork fit into the perimeter recess and/or inner recess directly.

According to another aspect the internal components of the formwork fit into the perimeter recess and/or inner recess indirectly by. inserting one or more cradle strips into the perimeter recess and/or inner recess to receive components of the formwork in the base sheet member.

According to another aspect two or more components of the formwork are inserted into a single perimeter recess and/or inner recess.

According to another aspect both the outer board and the internal bracing member are inserted into a single perimeter recess on the base sheet member.

According to another aspect providing a shelf member or discrete shelf members to mechanically couple the outer formwork to the internal bracing member.

According to another aspect inserting a first leg of the internal bracing member into a perimeter recess and inserting a second leg into the inner recess spaced inward from the perimeter recess.

According to another aspect a footing region and the base sheet member spans at least across the footing region.

According to another aspect the internal bracing members are generally flat.

According to another aspect installing rebar rebar chairs on the internal bracing members.

According to another aspect installing mesh reinforcement supported on an upper region of the internal bracing members within the formwork.

According to another aspect installing one or more void formers.

According to another aspect a feature of the void former engages in the inner recess of the base sheet member.

According to another aspect the outer boards are coupled to the void formers.

According to another aspect installing intermediate boards to form a stepped foot region.

According to another aspect adhering and components together using an adhesive.

According to another aspect the adhesive forms a seal between components.

According to another aspect providing ties to tie components together.

According to another aspect tightening the tie to bring the outer board and mesh reinforcement together.

According to another aspect the action of mechanically coupling components is one or more of the actions of:

i. Inserting,
ii. Hooking,
iii. Sliding,
iv. Wedging,
v. Interlocking.

According to another aspect the components packaged in one or more flatpack bundles.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

BRIEF DESCRIPTION OF THE DRAWINGS

The invention will now be described by way of example only and with reference to the drawings in which:

FIG. 23A shows a cross-section view of a height adjusting member.

FIG. 23B shows a cross-section view of an alternative height adjusting member.

FIG. 24A shows a side view of a discrete shelf member including a key formation.

FIG. 24B shows a top view of a discrete shelf member including an aperture.

DETAILED DESCRIPTION OF PREFERRED EMBODIMENTS

According to various aspects of the various embodiments of the present invention as illustrated in FIGS. 1 to 20D, there is provided an internally braced permanent formwork for concrete foundation construction. It will be appreciated that these figures illustrate the general principles of construction, and that the invention is not limited to the precise configurations illustrated.

The general structure of various embodiments of the present invention as shown in the figures will now be described followed by a description of the method of assembly of the permanent formwork 1.

Basic Structure

Figure 1:
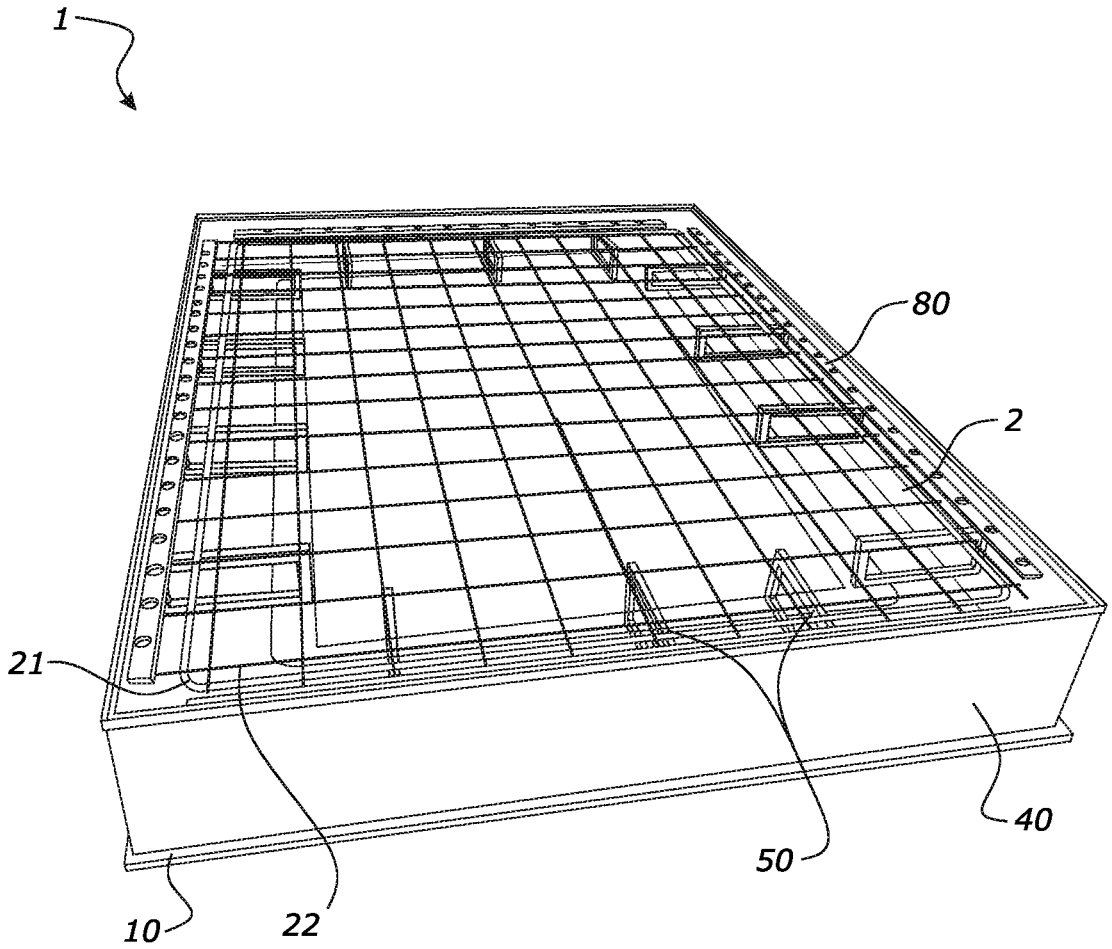
FIG. 1 shows a perspective view of an internally braced permanent formwork.

As shown in FIG. 1, the internally braced permanent formwork 1 comprises an base member 10 and one or more permanent outer boards 40 connected to the base member 10. In the most preferred embodiments, the base member 10 provides an insulating benefit and is therefore preferably formed of an insulating material having a thickness sufficient to provide an insulating performance benefit. It will be appreciated that an overall insulating performance benefit is derived from the combination of the thermal properties of the material selected, and it's thickness.

Alternatively, the base member 10 may be chosen to have very limited, or no thermal benefit. The resulting foundation in such a case will still have many of the other benefits of the present invention, but have less performance (at least in the area of the base member 10).

Throughout the specification, embodiments predominantly including an insulating base member 10, are described by way of example only.

The permanent outer boards 40 form an outer periphery to receive and contain concrete, and are not removed after the concrete has set. The outer boards 40 are permanently integrated with the concrete slab foundation and forms a permanent perimeter for the concrete foundation.

A permanent outer board 40 is beneficial as it acts as the exterior finish surface. Outer boards 40 with the desired appearance and physical qualities may be selected at the outset (before concrete is poured and set). A separate exterior cladding may not need to be applied after the concrete has set, thus saving time and extra material. Additionally, the outer board 40 may be selected to be a paintable material.

Preferably, the permanent outer board 40 comprises an insulating material. Forming the outer board 40 from an insulating material is advantageous as it reduces heat loss from the sides of the concrete slab foundation. Forming the outer board 40 from an insulating material saves time as insulation does not need to be added after the concrete has set, which is a laborious task.

In the preferred configurations, the permanent outer boards 40 is a composite board formed from two or more materials with different properties. A layer of the outer board 40 comprises insulating properties, and another layer of the outer board has a desired exterior finishing.

In some configurations, the outer board 40 comprises an insulating inner layer which is bounded by another material with the desired exterior finishing.

In some configurations the outer boards 40 are formed from PVC foam board. PVC foam board has advantages such as the outer surface layer being generally resistant to water, can be a desirable exterior finish surface, is cheap and rigid. Additives may be used to improve the fire retardant properties. The exterior finish surface may be painted easily, or protect the inner layer such as during transportation and/or handling of the boards.

In some configurations, the outer board 40 may comprise a plastic layer to protect the outer board. In some configurations, the plastic layer may be removable to expose a desirable exterior finish surface.

The foam in the PVC board functions as insulation. Additional side insulation does not need to be applied to the concrete slab after the concrete has set, further saving time and extra material.

It is anticipated the permanent outer board 40 can be formed from other materials. For example, the permanent outer board 40 may be formed from fibreglass, polymers, or cement board (although not limited to these materials).

In the preferred configurations, the permanent outer board 40 is a laminate structure comprising two or more layers of the same or different material.

Preferably, the outer board 40 has suitable insulation properties, a desirable exterior finish surface, is cost-effective, and/or is easily machinable.

It is anticipated that any suitable materials known in the art can be used for any of the components of the internally braced permanent formwork 1. Preferably, the materials have suitable characteristics such as strength, durability, insulation etc.

In the preferred configurations, components of the internally braced permanent formwork 1 form a concrete footing region 2. Preferably, the footing region 2 is located towards the perimeter, around the formwork 1 as referenced in FIGS. 1 and 10. The footing region 2 is designed to receive a relatively large volume of concrete (and reinforcing) to support important structural components of the building such as cladding, walls columns and/or beams.

Figure 15:
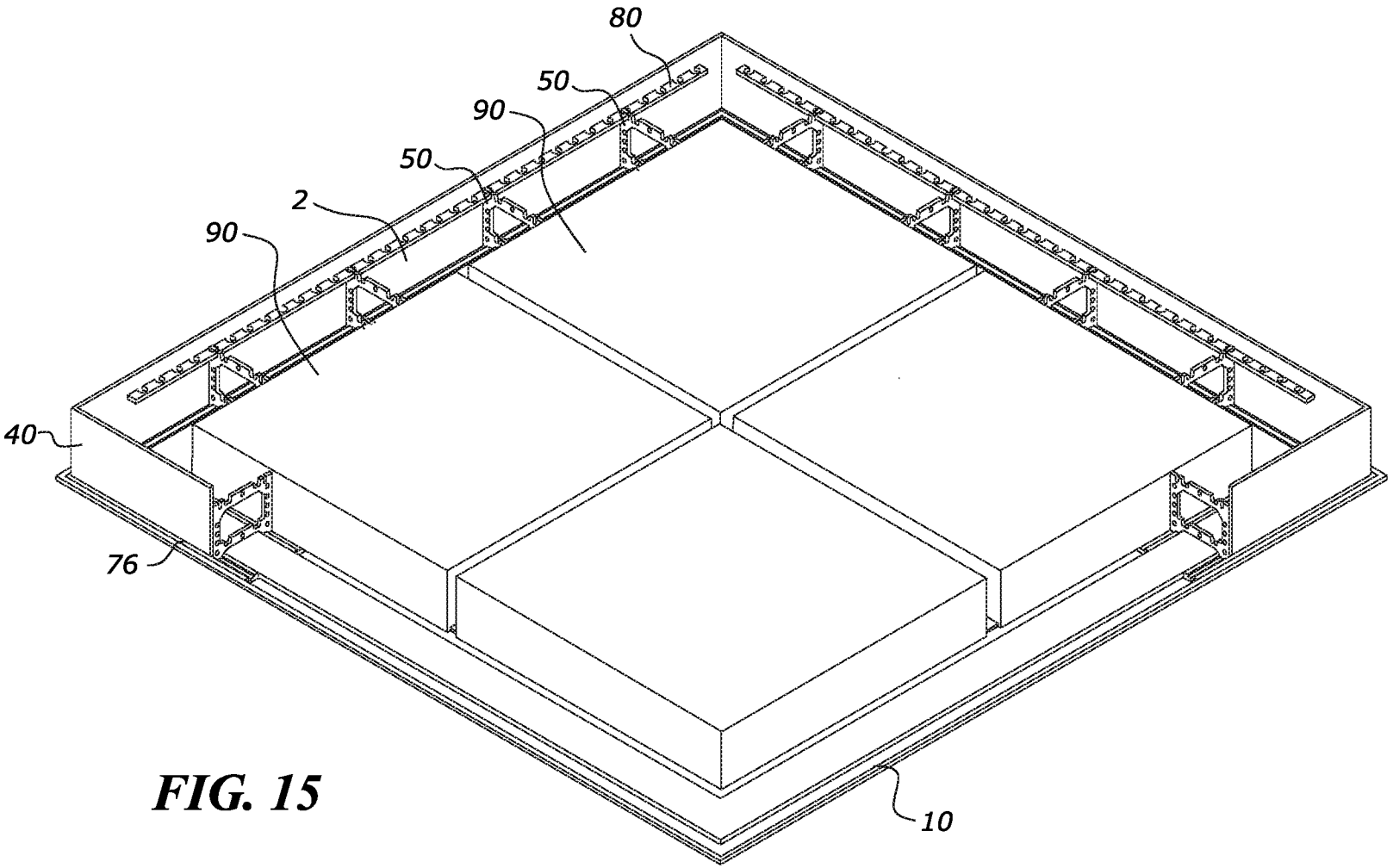
FIG. 15 shows a schematic perspective view of the formwork with void formers.

As shown in FIG. 15, preferably the footing region 2 of the slab is a thick region which receives concrete. In some configurations as shown in this figure, the footing region 2 is the space defined between the outer board 40 and an internal component such as a void former 90.

In some configurations, the footing region 2 is between 200 mm and 600 mm wide.

In the preferred configurations, the footing region 2 is between 250 mm and 350 mm wide.

In some configurations, the footing region 2 is between 100 mm and 600 mm deep.

In the preferred configurations, the footing region 2 is between 200 mm and 400 mm deep.

Preferably, the footing region 2 is reinforced to limit the likelihood of structural failure or the possibility of concrete cracking, and design of the footing is generally well known in the art.

In the preferred embodiments, the permanent outer boards 40 are coupled to one or more internal components of the formwork in order to prevent the outer boards from tipping over when it receives wet concrete. Internal components may be defined as the components which are within the boundaries of the outer boards 40. For example, internal bracing members 50 and void formers 90 are generally internal members. It is anticipated that the outer board 40 may be connected to other internal components and is not limited to the components described here.

Coupling the outer boards 40 to internal components may help keep the outer boards 40 connected with the other components of the formwork 1. This is important as the formwork 1 is intended to be used to receive wet concrete which generally exerts a large outward pressure against formwork prior to the concrete setting. The formwork 1 needs adequate bracing to minimise the likelihood of components disconnecting or misaligning due to movement of components. The formwork 1 system as described is easy and quick to erect, and results in a robust formwork suitable for pouring a foundation slab.

In the preferred embodiments, the internally braced permanent formwork 1 comprises a plurality of internal bracing members 50 to support and maintain the structural integrity of the outer boards 40. The internal bracing members 50 are connected to the outer boards 40 to keep the boards upright as the concrete is poured into the formwork 1.

To reinforce the concrete, the formwork 1 comprises rebar 21 in the preferred configurations. Preferably, rebar 21 is located at least in the footing region 2.

In the preferred configurations, the formwork 1 also includes mesh reinforcement 22. Preferably, the mesh reinforcement covers a large area of the concrete defined by the outer boards 40. In some configurations, the mesh reinforcement is a steel mesh such that well known in the art.

Figure 11:
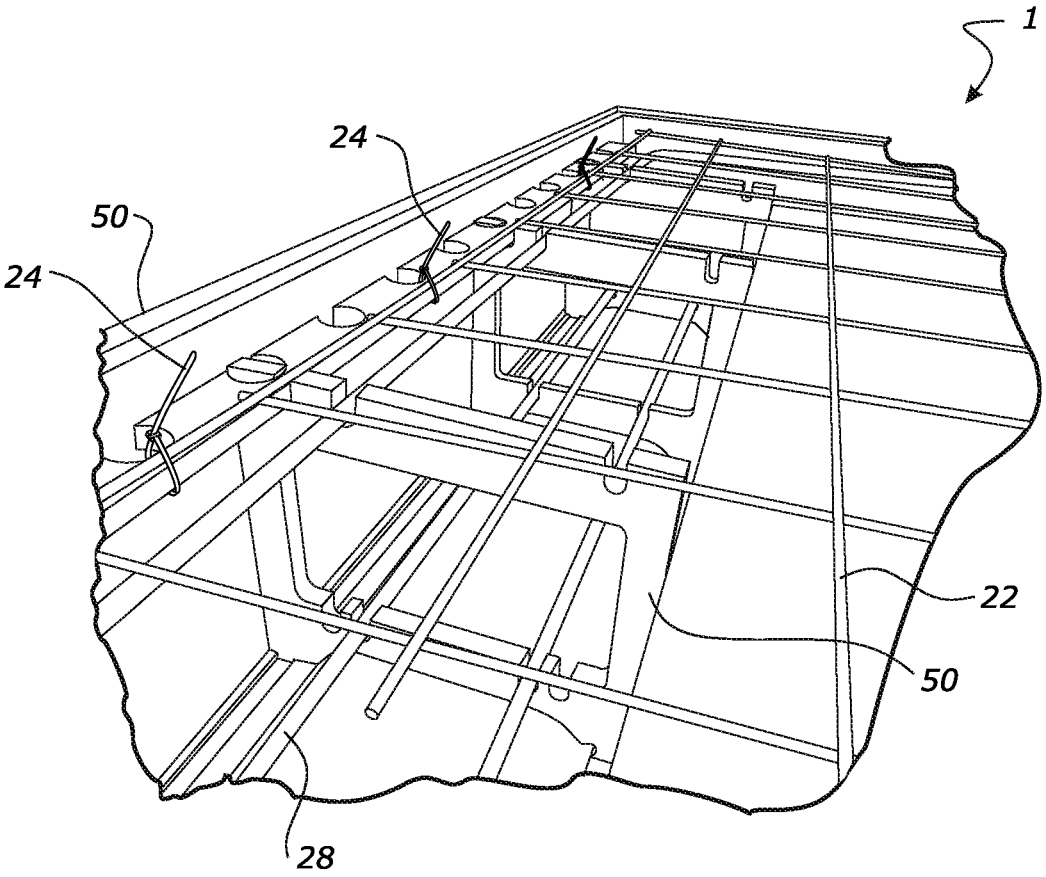
FIG. 11 shows a top perspective view of the formwork including mesh reinforcement.

As shown in FIG. 11, the mesh reinforcement 22 normally sits in the upper region within the formwork 1. Mesh reinforcement 22 preferably reinforces a top layer of the concrete slab foundation.

Base Member—Insulation and Recesses

In the preferred configuration, the base member 10 is a sheet. The sheet may be continuous or comprise of multiple sections which are placed together to form a bigger sheet.

Preferably, the base member 10 covers at least the footing region 2. Although, in the in the most preferred configurations, the base member 10 is under the entire slab. A base member 10 which spans the entire slab provides better base insulation. Furthermore, it provides a level surface to receive components within the formwork 1 more easily.

In some configurations, such as where insulated polystyrene pod are utilised, or slabs including void formers, sufficient insulation may be incorporated into the slab elsewhere, and therefore it may not be necessary for base member 10 to extend under the entire slab.

Similarly, in configurations where the base member 10 is not intended to act as a significant insulator, may not be necessary to have the base member 10 extend under the entire slab for example, the base member 10 may only be found around the perimeter of the slab in order to engage with the outer boards 40 and bracing members etc.

Preferably, the base member 10 (insutating or not) is located around the perimeter of the slab, and is at least 600 mm wide (spanning from the edge 15 of the formwork 1).

In some configurations, the insulated base member 10 is between 15 mm and 100 mm thick.

Preferably, the insulated base member 10 is between 15 mm and 30 mm thick, while a less insulating base member may be less than 15 mm thick In the preferred configurations the base member 10 comprises an insulating material. In some configurations, the base member 10 is formed from polystyrene. This is a light material with beneficial properties. Polystyrene is insulating, and is light which makes easy to transfer and reduces strain on workers. Polystyrene may be advantageous as it is easy to create recesses 13, 14 to receive components and is a cheap material to use. Other materials with suitable insulating, machining and strength properties may also be used. Extruded polystyrene (EPS) and/or expanded polystyrene (XPS), having both found to have suitable properties.

The insulating base member 10 and the insulated permanent outer boards 50 work in synergy to form an insulating mould to receive concrete. This is advantageous as the permanent formwork 1 will improve the insulating properties of the concrete slab foundation, and reduce heat loss. Additionally, insulation does not need to be applied after the concrete slab has formed, therefore saving time and simplifying the process of forming a concrete slab with desired insulating properties.

If additional insulation is desired around the edge of the slab, additional layers of insulating material may be placed on the inside of outer boards 40 (i.e. between bracing members 50 (see figure X).

Traditionally, exterior insulation is added after the concrete has set to try improve the insulating properties of a concrete slab. However, exterior insulation can be difficult to install, and is an extra step which is time consuming and potentially expensive.

Furthermore, traditionally insulation is not generally installed beneath a concrete slab. The advantage of the present invention in the preferred configurations, is that it provides an insulating formwork which is insulated by both the outer boards 40 and the base member 10, so that less heat escapes through the sides, base and the edges where the boards and base member meet (i.e. the formwork provides an insulated side, base and edge).

In some configurations, a more rigid material than polystyrene may be used for the insulated base member 10. This may be advantageous, particularly where components (such as the outer board and internal members) are directly coupled to the insulated base member.

In some configurations, the insulated base member 10 comprises foam or rubber.

It is anticipated that other suitable materials may be used as the insulated base member 10.

In some configurations, where the insulated base member 10 comprises a flexible material like rubber, the base member may be rolled up for easy transport, and then unrolled onsite or at an assembly location.

In the preferred configurations, the insulated base member 10 is 15 mm to 60 mm thick.

Increasing the thickness of the insulated base member 10 can improve insulation properties, and help keep components upright as recesses are formed on the base member.

Preferably, the insulated base member 10 comprises one or more features configured to receive components of the formwork 1, and in particular the outer boards 40.

Figure 2:
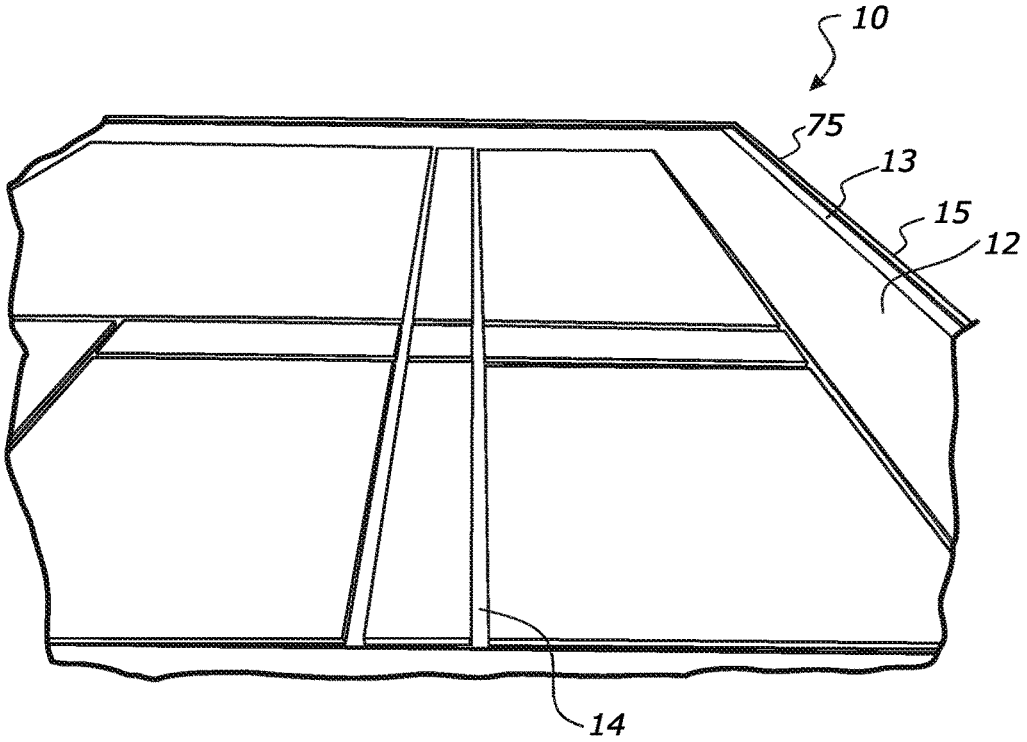
FIG. 2 shows a segmented perspective view of an insulated base member with recesses.

For example, the insulated base member 10 may comprise one or more recesses 13, 14 on an upper surface 12 of the base member as best shown in FIG. 2. The recesses 13, 14 may be directly or indirectly formed on the upper surface to receive components of the formwork 1. The recesses 13, 14 are arranged and sized to receive some components of the internally braced permanent formwork 1, in order to hold, seal and/or easily locate components.

In the preferred configurations, the perimeter recess 13 extends substantially the length of the insulated base board 10 to receive the outer boards 40 (standing upright on edge).

As shown in FIG. 2, in the preferred configurations, the insulated base member 10 comprises a perimeter recess 13. The perimeter recess 13 is located towards the perimeter of the concrete slab foundation to receive the outer board 40.

Figure 3:
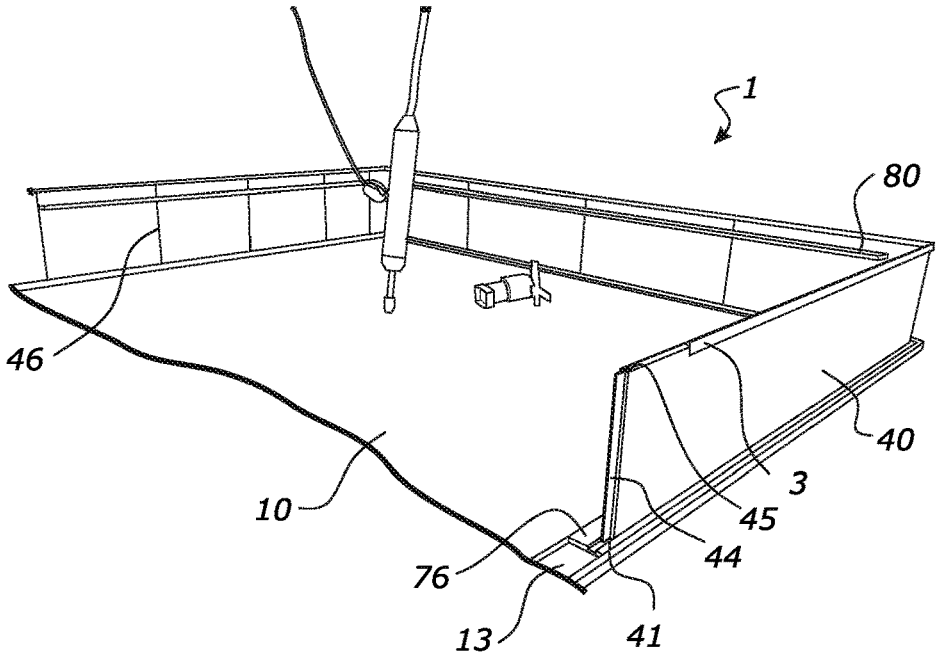
FIG. 3 shows a perspective view of a formwork with a cradle in an insulated base member recess, creating a lip.
Figure 4:
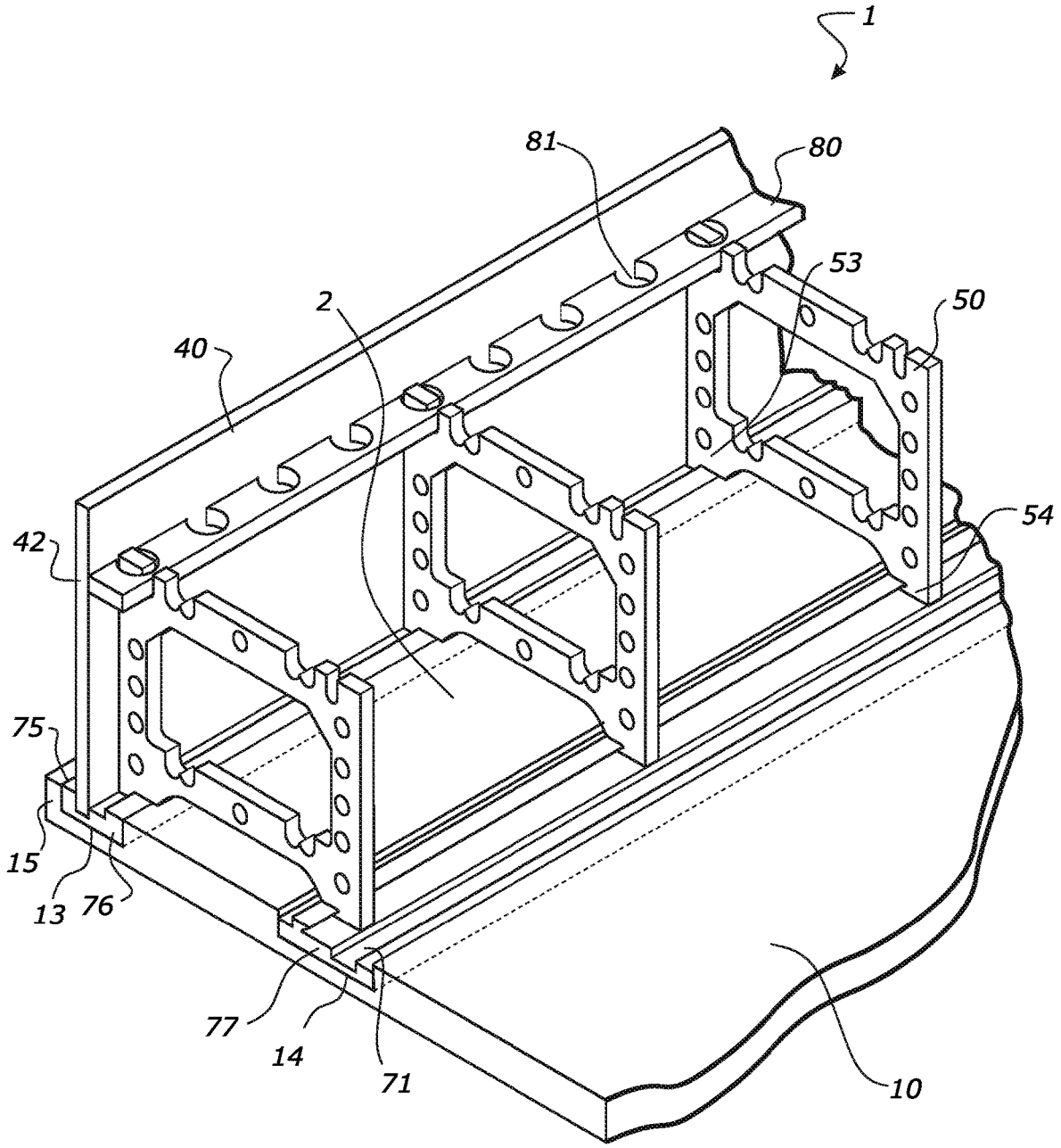
FIG. 4 shows a perspective view of internal bracing members indirectly connected to the outer boards and the insulated base member.

Preferably, each outer board 40 is connected to the insulated base member 10 so that a lower edge 41 of the outer board engages in the perimeter recess 13 as shown in FIGS. 3 and 4.

In some configurations, the insulated base member comprises two types of recesses 13, 14. The insulated base member 10 comprises perimeter recesses 13 (described above), and further comprises inner recesses 14 configured to receive internal components of the formwork. Inner recesses 14 are located inwards from the perimeter of the concrete slab, on the upper surface 12 of the base member 10. Inner recesses 14 are configured to receive internal components (such as internal bracing members 50, and not the outer board).

In some configurations, the inner recesses 14 are continuous. The inner recess 14 span a length of the insulated base member 10.

In other configurations, the inner recesses 14 are discrete. Multiple inner recesses 14 span a length of the insulated base member 10.

In some configurations, the recesses 13, 14 receives a single component of the formwork 1 as shown in FIG. 3 such as the outer board 40.

In other configurations, a single recess 13, 14 receives two or more components of the formwork. In one configuration for example, as shown in FIG. 4, the perimeter recess 13 receives both the outer board 40 and the internal bracing member 50.

It is anticipated that the perimeter recess 13 can be arranged and sized to receive other components as necessary.

A purpose of the recesses 13, 14 in the insulated base 10 is to provide a snug-fit for components of the formwork 1. Preferably, the recesses 13, 14 are sized and profiled to firmly keep the component it receives secure so that it is not easily moved out of place.

In some configurations, adhesive may be added to adhere components together. In some configurations, the adhesive additionally forms a seal between components. Adhesive can help components stay together and/or limit the likelihood of the concrete leaking through joints.

Although adhesive may not be necessary in some configurations, such as where the components fit each other in a tight joint, adhesive may enhance the system by further securing connections and/or sealing the system.

Adhesive may be particular useful between the outer board 40 and the insulated base member 10 where sealing is important so that concrete does not leak out through between the outer board and insulated base member.

Glues, tapes or other sealants may be used to improve the connection between components. For example, polyurethane-based, PVA, PVC solvent glues may be used. It is anticipated that any adhesive known by a person skilled in the art to be suitable for the particular component materials to be adhered.

In the preferred configurations, the perimeter recess 13 is configured to receive an edge of a board or wall (such as the outer boards 40 and bracing members 50 best illustrated in FIG. 4). The perimeter recess 13 helps keep the components in place relative to the insulated base member 10. In some configurations (such as when the recess is deep), the perimeter recess 13 helps keep components upright during assembly of the formwork.

Preferably, the combination of the perimeter recess 13 locating and sealing the outer board 40 while providing internal bracing members 50 to keep it upright, work in synergy to provide a stable outer periphery to receive concrete.

It will be appreciated that during the first layup stage, the component members are preferably easily placed and held in position. At this stage it is not absolutely necessary for the components to be able to withstand the entire weight of wet concrete poured into the formwork, as the addition of concrete reinforcing bar, wire mesh and wire ties etc (as generally known in the art), may significantly contribute to the strength of the completed formwork prior to pouring.

In the preferred configurations, the recesses 13, 14 are slots. Preferably, the insulated base member 10 comprises slots 13, 14 with a suitable slot depth and slot length to receive the desired components.

Preferably, a perimeter slot 13 is formed around the perimeter of the concrete slab.

The recesses 13, 14 are configured to receive components of the formwork either indirectly or directly.

In some configurations, the recesses 13, 14 receives components of the formwork indirectly so that the component is connected to the insulated base member 10 via one or more intermediate members 76, 77 as shown in FIG. 4. The component engages the recess 13, 14 of the insulated base member 10 by means of an intermediate member 76, 77.

An advantage of indirectly connecting components of the formwork 1 to the insulated base member 10 is to allow for more simple recess profiles in the base member. As shown in FIG. 2, simple standardised rectangular slots are created on the insulated base member 10. Customised connections between different components and the insulated base member 10 can be achieved by using a custom intermediate member 76, 77 between the component and the base member.

In some configurations, the formwork 1 comprises one or more cradle strips 76, 77 as best illustrated in FIGS. 3 and 4. Cradle strips 76, 77 can be inserted into the recesses 13, 14 of the insulated base member 10, which in turn receive components of the formwork.

The cradle strips may be formed from plastic, foam board, wood, powder-coated aluminium. Alternatively, other suitable materials may be chosen by a person skilled in the art.

Preferably, the cradle strips are formed from a material which is easily machinable. For example, the cradle strips may be injection moulded or extruded for example.

In some configurations, the cradle strips 76, 77 extends the majority or the entire length of the recess 13, 14 as shown in FIG. 4.

Figure 7:
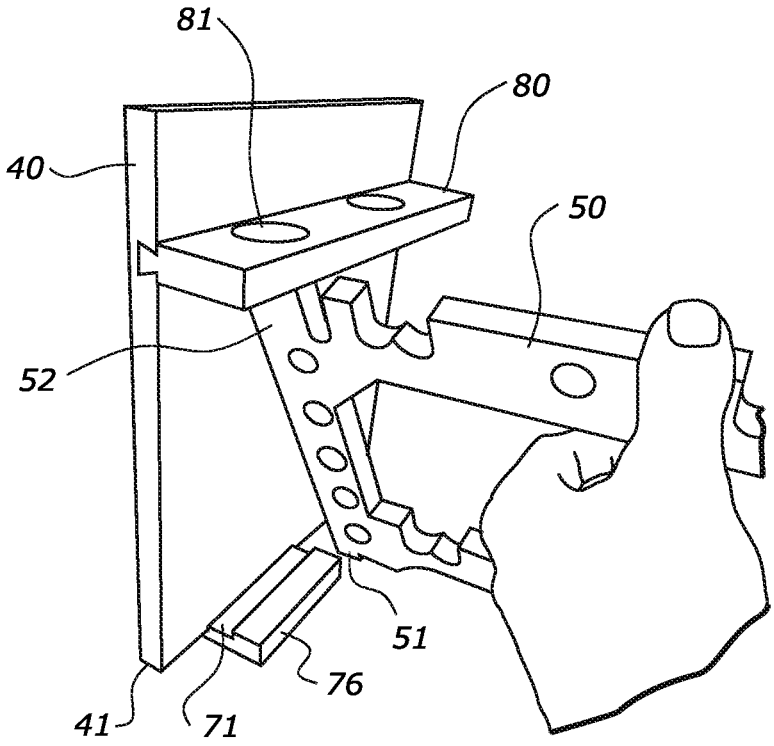
FIG. 7 shows a perspective view of an internal bracing member being connected the outer board.

In other configurations, the cradle strip 76 or an equivalent intermediate member is a shorter piece (as shown in FIG. 7) and does not extend the length of the recess 13.

As shown in FIG. 4, in the preferred configurations, the cradle strip 76 comprises an inner slot 71 configured to receive one or more components of the formwork. Preferably, the inner slot 71 of the cradle strip 76, 77 comprises a cross-sectional area which is less than the recess 13, 14. Once the cradle strip 76, 77 is inserted into the recess 13, 14 one or more components of the formwork can be inserted into the inner slot 71 which is comparatively small allowing for a snug-fit, in order to keep the components upright.

Preferably, the inner slot 71 of the cradle strip 76, 77 comprises a profile which is complimentary to the components which it is designed to receive.

Figure 6:
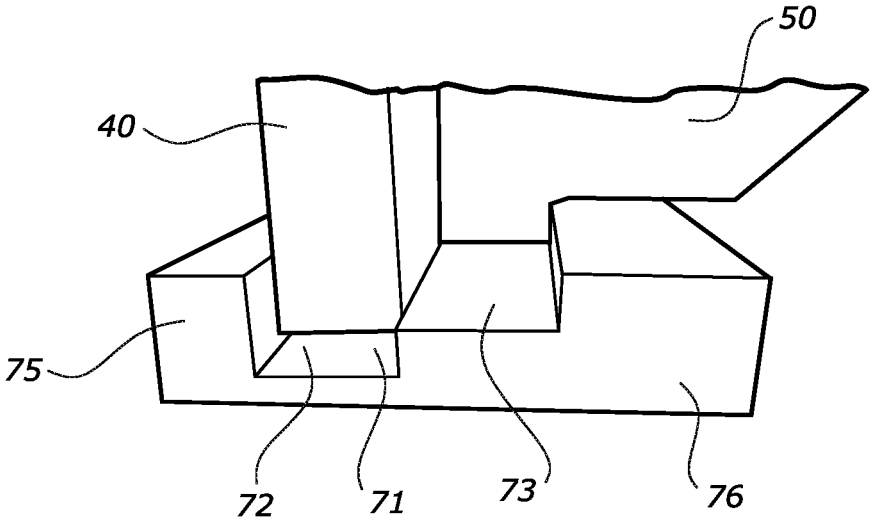
FIG. 6 shows a side view of a cradle strip receiving components of the formwork.

FIG. 6 shows a perimeter cradle strip 76 configured to receive the outer board 40 and internal bracing member 50.

Figure 16:
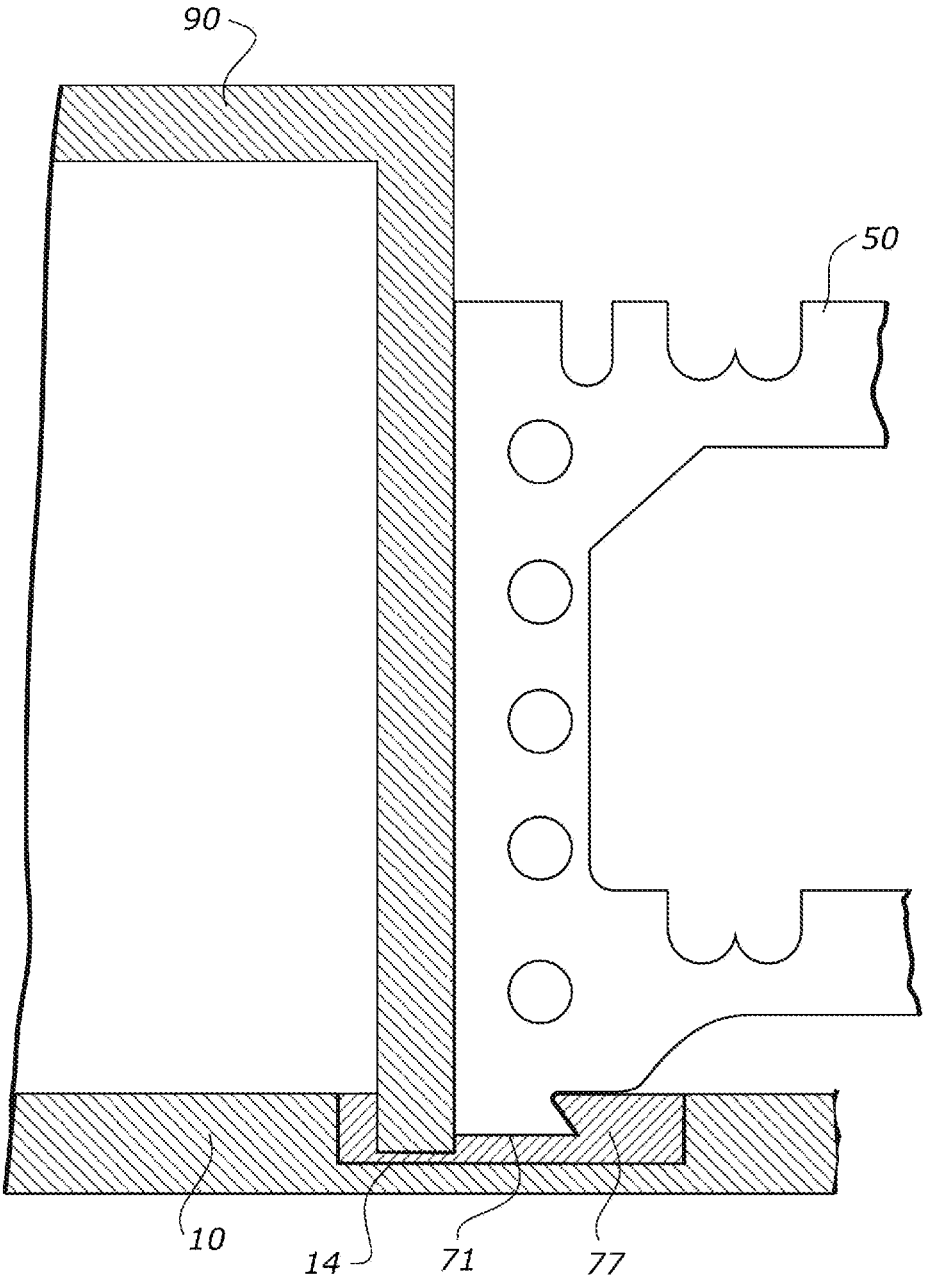
FIG. 16 shows a side view of a cradle strip and an internal bracing member and a cardboard/hollow void former.

FIG. 16 shows an inner cradle strip 77 configured to receive a void former 90 and an internal bracing member 50.

In some configurations, the cradle strip 76, 77 comprises a stepped inner slot 71 receiving two or more components as best shown in FIG. 6. The inner slot 71 has a first depth region 72 to receive a first component and a second depth region 72 to receive a second component. An inner slot 71 with different depths may help multiple components stay in place during assembly within the same inner slot.

Using cradle strips 76, 77 with customised inner slots 71 allows the internally braced permanent formwork 1 to be easily tailored to include different components to achieve a concrete foundation with different desired physical characteristics.

Another advantage of inserting cradle strips 76, 77 into the insulated base member 10 is to increase the stiffness of the base member. In some configurations, the insulated base member 10 is formed from polystyrene or similar materials. Inserting (relatively) rigid cradle strips 76, 77 into the recesses 13, 14 of the insulated base member 10 will reinforce the base member. A stiffer base member 10 may be beneficial especially during transportation of the base member.

Preferably, the cradle strip 76, 77 comprises a different material from the insulated base member.

Preferably, cradle strip 76, 77 comprises a stiffer material than the insulated base member.

Preferably, the some or all of the cradle strips 76, 77 are preinstalled in the insulated base member 10 prior to being transported.

In other configurations, the recesses 13, 14 receives components of the formwork directly so that the component itself engages with the recesses which may be formed into base member 10. It will be appreciated that these options allow some flexibility with respect to the material choice of each member. For example, a relatively more expensive material may be chosen for cradle strips 76, 77, with better strength, thereby allowing a relatively cheaper and more fragile material (or difficult to machine or form into complex shapes) to be used for the insulating layer.

Figure 9:
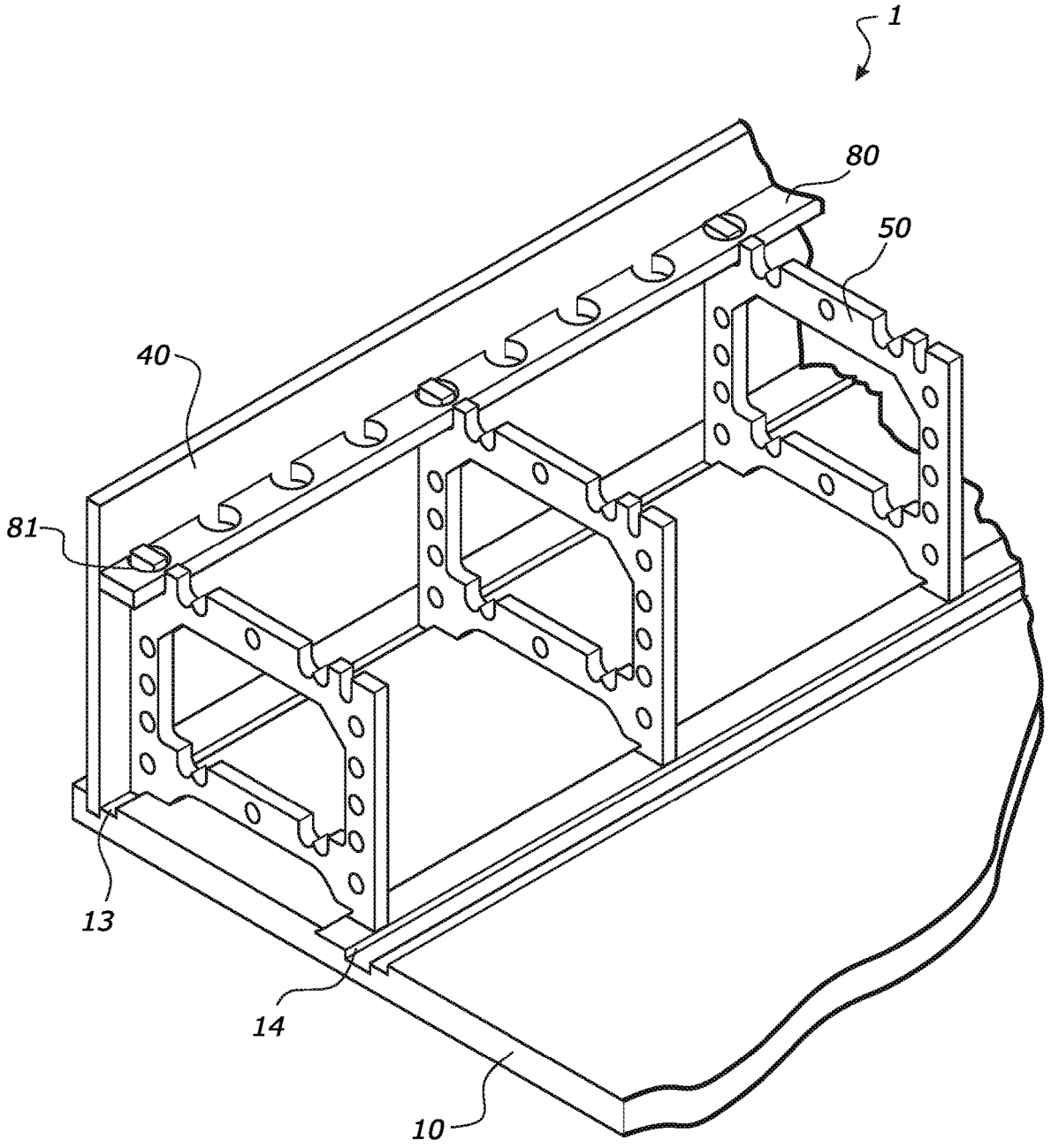
FIG. 9 shows a perspective view of internal bracing members directly connected to the insulated base member.

An example of this is shown in FIG. 9, where the outer board 40 and internal components (such as the internal bracing member 50) directly engages with the perimeter recess 13 in the insulated base member 10. Furthermore, the profiles of the perimeter recesses 13 in the insulated base member 10 correspond with the outer board and internal bracing member 50. Receiving components of the formwork directly may be beneficial, as fewer components are required. However, a thicker or stronger base member 10 may be necessary to support direct engagement between the base member and the components it receives.

Figure 20A:
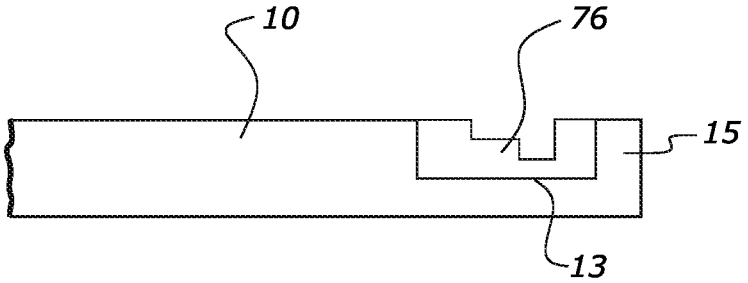
FIG. 20A shows a side view schematic of a formwork with a cradle strip in an insulated base member recess, creating a lip.
Figure 20B:
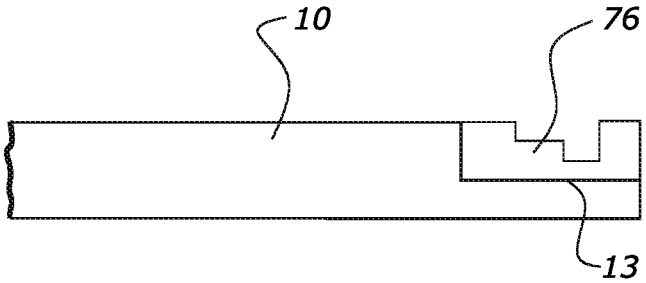
FIG. 20B shows a side view schematic of a formwork with a cradle strip in an insulated base member in a stepped recess.
Figure 20C:
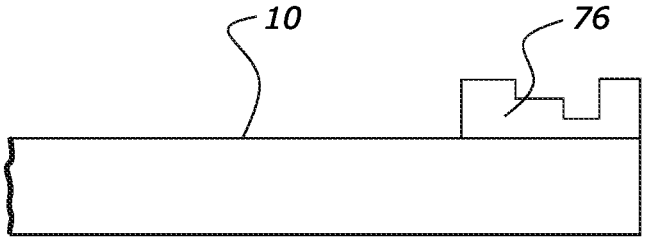
FIG. 20C shows a side view schematic of a formwork with a cradle strip on top of the insulated base member.

Similarly, in embodiments where an insulating base member is not desired or required, it may be preferable to utilise a thin base member 10 and add a cradle strip to the top surface (see for example FIG. 20C).

Prefabrication

Another advantage of the recesses 13, 14 in the insulated base member 10 is to help predefine the position of formwork components. The recesses 13, 14 help define the location of components which sit on top of the insulated base member 10. This may be advantageous as traditionally positioning the formwork components into appropriate positions may be a laborious and time-consuming task.

The present invention allows for the manufacture of pre-formed components (potentially off-site), resulting in simple and rapid assembly, in the precisely correct location on-site. An advantage of the present invention is that the connections are reversible (if adhesive has not been included). Connections between components such as the outer board 40 and the internal bracing member 50 can be adjusted as necessary, allowing for flexibility during assembly, as a result of design changes etc.

The present system lends itself to be easily assembled on-site or off-site.

The components may be delivered as a kit from the manufacturer to an off-site location, to be pre-assembled and then transported onsite ready to for the concrete pour in modules.

The components may alternatively be fully assembled at a manufacturing factory, ready to be transported onsite ready to for the concrete pour.

Alternatively, a kit of components may be delivered onsite to be quickly assembled on the construction site by fitting parts of the formwork 1 together.

Prefabrication of some or all components of the formwork 1 may be useful as it reduces the amount of time required onsite. Improving the efficiency of forming concrete foundation by prefabricating components of the formwork 1 allows workers to take advantage of shorter windows of good weather, reduce labour costs, and/or make way for other construction tasks which need to be performed on site. Furthermore, off-site preparation may be beneficial as offsite machinery can be taken advantage of to reduce labour required.

Modules

In some configurations, prefabricated modules of the present invention are preassembled, and transported onsite. The prefabricated modules may be craned on-site and be ready for a concrete pour soon after the modules are joined together, and any supplementary components have been installed.

Prefabricated modules are units which include important structural components of the formwork 1 connected together offsite to reduce time required to prepare for a concrete pour on-site.

In some configurations, the prefabricated modules are assembled to include at least the outer boards 40, insulated base member 10 and internal bracing members 50.

Optionally, the prefabricated modules also include components such as void formers 90, rebar 21, ties and/or mesh reinforcement 22. However, it is anticipated that workers may choose to incorporate heavier components such as rebar 21 after the module has arrived on-site.

Multiple prefabricated modules may be transported onsite and joined together to create a larger formwork 1 to form the shape of the desired concrete slab foundation.

Preferably, neighbouring modules are joined together so that concrete is contained within the formwork and will not leak out.

Preferably, neighbouring insulated base members 10 are joined so that there is no uplift of the member, such as when the concrete is pumped into the formwork 1.

It is anticipated a range of joining methods may be used to join neighbouring modules. Preferably, the components comprise complementary features which abut or fit each other.

Preferably, neighbouring outer boards 40 are joined together along the joint 46.

In the preferred configurations, a top strip 3 as referenced in FIG. 3 is installed on top of the outer boards 40 to join neighbouring boards 40 and improve the structural integrity of the formwork 1. The precise form of top strip 3 may vary according to user requirements. In particular, an additional top strip 3A may be added in order to easily vary the thickness of the top layer of concrete in a foundation slab. Such a system allows the main components of the system to be the same, and only the top strip 3A needs to be varied, in order to accommodate different thickness slabs. An example of such a variant is described later in relation to FIGS. 23A & B.

Preferably, the top strip 3 spans across joints 46 to hold neighbouring outer boards 40 in position.

In some configurations, the top strip 3 is a metal strip such as aluminium. The top strip 3 may be formed from other suitable materials such as plastic for example.

Preferably, neighbouring insulated base members 10 may also be joined together.

For example, edge to edge butt joints, tongue and groove joints, lap joints, or biscuit joints may be used.

It is anticipated that other joining methods known in the art may be used, and the joining method is not limited to the listed methods above.

In some configurations, the tongue and groove is formed into the components (e.g. outer boards and/or insulated base member) itself. In other configurations, grooves are formed in both component edges, and a loose tongue is inserted to join the two edges together, or an extruded member having a generally "H" shaped cross section may be used To supplement the joints between modules, adhesive or tape may be applied to the joint.

Prefabricated modules which cover a smaller surface area may be used where the concrete slab is a more complex shape.

Preferably, prefabricated modules cover a relatively large surface area, so that fewer modules are required to form the mould for a concrete slab foundation.

In some configurations, the prefabricated modules is sized to fit and be transported on a truck.

In some configurations, the modules can include pre-installed services.

Outer Board Connections

The outer boards 40 may be continuous board as shown in FIG. 1 or comprise of multiple board sections connected together to form a longer board as shown in FIG. 3.

In the preferred configurations, the outer board 40 is configured to engage and connect to internal components of the internally braced permanent formwork 1 to withstand the pressure of concrete.

The connections of the present invention are designed to effectively hold together during assembly of the formwork. The connections also need to hold together to withstand pressure exerted by wet concrete, after it has been poured into the formwork 1 (before it sets).

Figure 5:
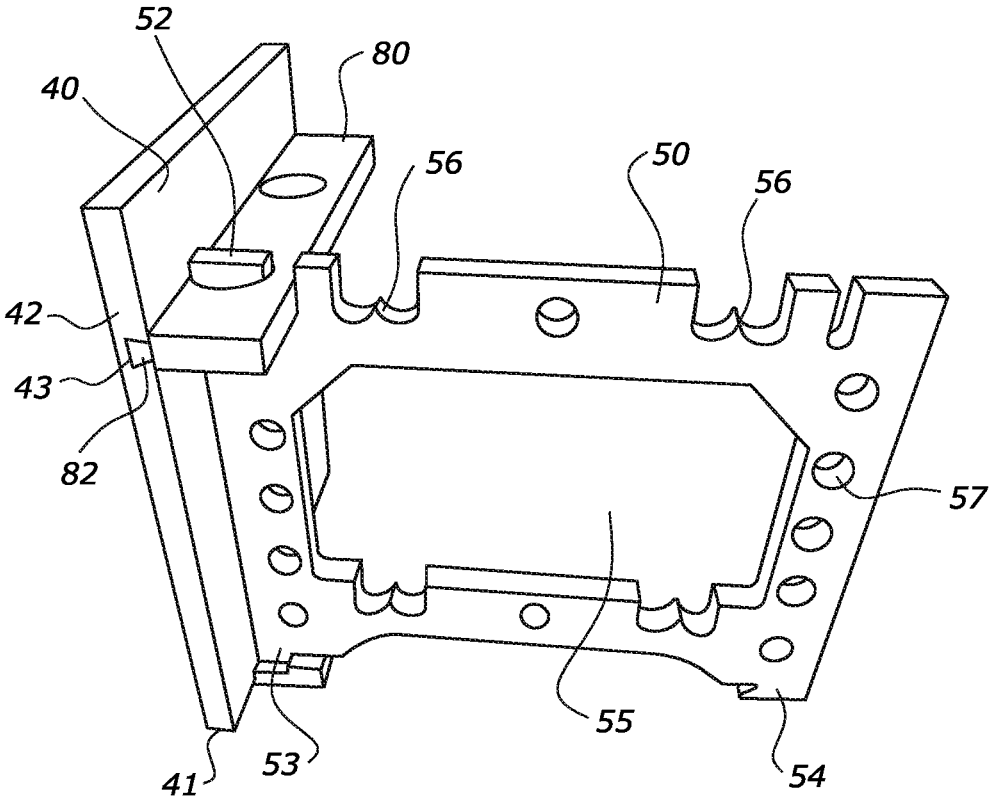
FIG. 5 shows a perspective view of an internal bracing member connected to the outer board.

Connections of the outer board 40 components of the formwork 1 in one preferred configuration shown in FIGS. 4 and 5.

Preferably, the outer board 40 is connected at or towards the lower edge 41. Connection at or towards the lower edge 41 of the outer board 40 is important to stop wet concrete leaking or bursting out of the formwork 1 beneath the board.

In the most preferred configurations, each outer board 40 is connected to the insulated base member 10 by inserting the outer board into the perimeter recess 13 of the insulated base member so that a lower edge 41 of the outer board engages in the perimeter recess 13 as shown in FIGS. 3 and 4.

In some configurations, the perimeter recess 13 is a slot having a lip 75 as referenced in FIGS. 2, 4 and 6. The lip 75 is located adjacent the outer board 10 and is configured to secure the outer board and provide extra resistance against wet concrete.

In some configurations, the lip 75 is formed by the base member 10 as best shown in FIG. 4. Preferably, the perimeter recess 13 is spaced from the edge 15 of the base member 10, so that the lip 75 can be formed by the base member as shown in FIGS. 2 and 20A. Adhesive may not be necessary in this configuration, however may still be included to supplement the connection.

Alternatively, as shown in FIG. 6, the perimeter cradle strip 76 is located at the edge of the insulated base member 10 as shown in FIGS. 18, 19, 20B, and 20C.

Figure 18:
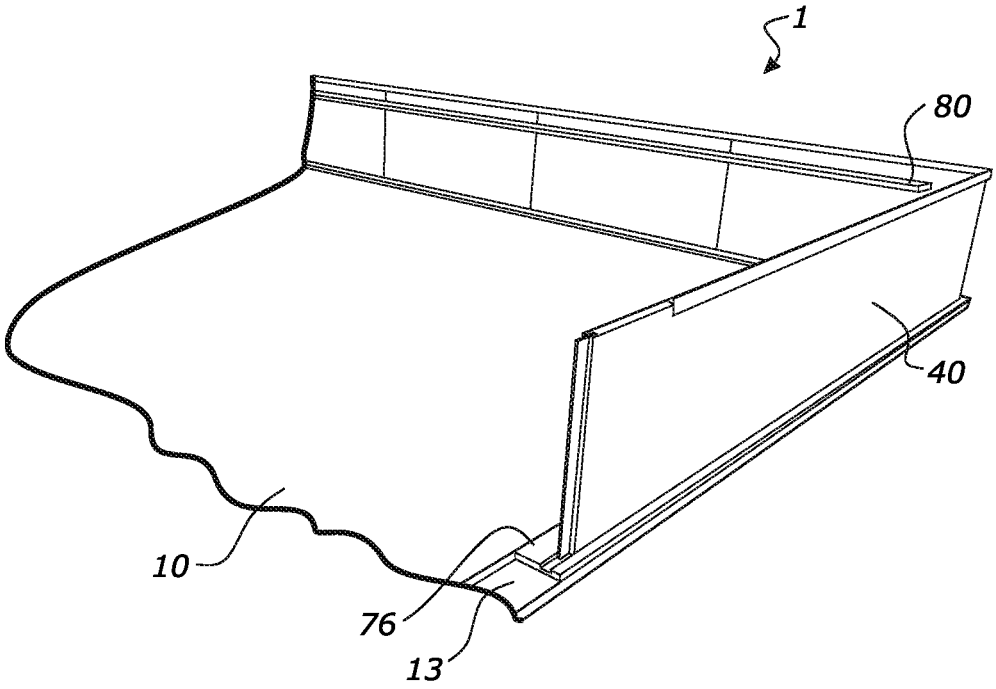
FIG. 18 shows a perspective view of a formwork with a cradle in an insulated base member recess.

In some configurations, the perimeter cradle strip 76 sits on a perimeter recess 13 as shown in FIGS. 18 and 20B.

Figure 19:
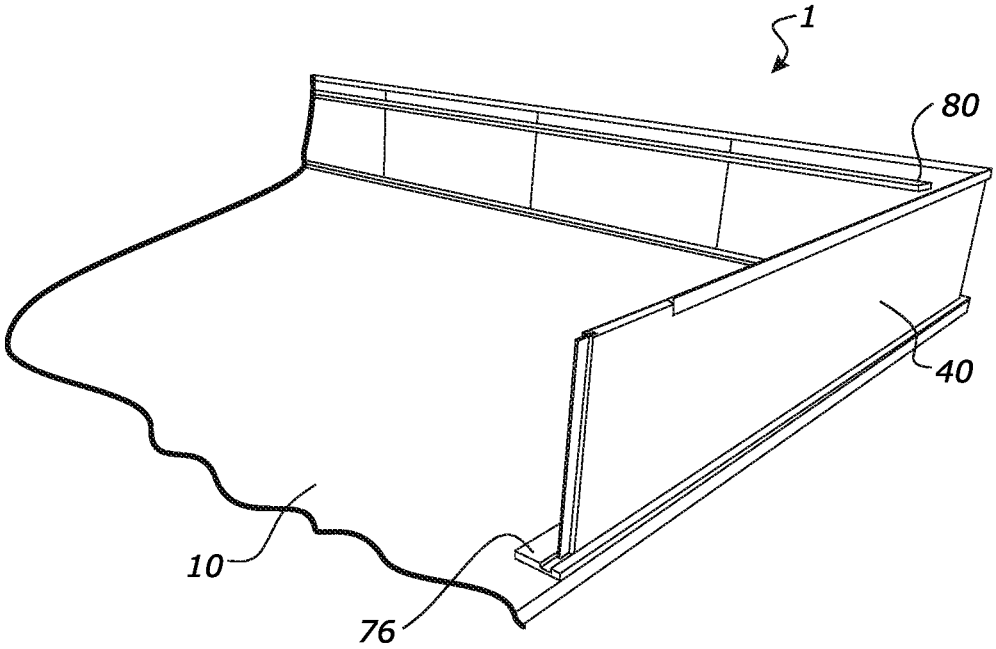
FIG. 19 shows a perspective view of a formwork with a cradle on top of the insulated base member.

In other configurations, the perimeter cradle strip 76 sits on the upper surface 12 of the (optionally) insulating base member 10 as shown in FIGS. 19 and 20C. Adhesive will be useful in this configuration.

Figure 20D:
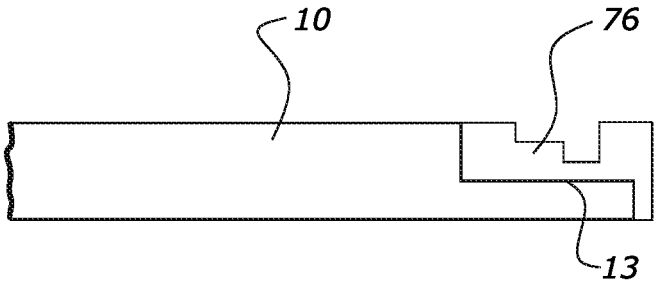
FIG. 20D shows a side view schematic of a formwork with a cradle strip pressed against the insulated base member.

In yet another configuration, as referenced in FIG. 20D, the perimeter cradle strip 76 is located in the perimeter recess 13. The perimeter recess 13 in this configuration is a step recess. The perimeter cradle strip presses sideways against the insulated base member to locate the cradle. In some configurations, as illustrated in FIG. 20D, a lower region of the perimeter cradle extends below its body to locate the cradle against the insulated base member.

Preferably, the outer board 40 is also connected at the upper region 42. The upper region 42 of the outer board 40 is the region is situated more than half way up the board. Connection in an upper region 42 of the outer board 40 is important to help the outer board stay in place and upright under the pressure of wet concrete. Having the outer board 40 connected towards the top of the outer board helps limit or prevent it tipping over due to the pressure of wet concrete.

In the preferred configurations, the permanent outer board 40 is coupled to an internal component from an upper region 42 of the outer board to provide support against tipping once the concrete has been poured.

The connections at the upper region 42 and the lower edge 41 of the outer boards 40 work together in synergy to form a strong and stable outer periphery to receive and contain the concrete. Connections at the upper and lower regions allows the outer boards 40 to withstand the pressure from the concrete in a balanced manner.

Internal bracing members 50 are coupled to the outer board as shown in FIG. 4.

Bracing Member Connections

The internal bracing members 50 in the present invention are integrated internally into the formwork, providing a compact solution to support the outer boards 40. The internal bracing members 50 remain in the concrete and do not need to be removed, saving time.

In contrast, external stakes are traditionally used to keep formwork boards in place and upright. However, external stakes can get in the way during construction and need to be removed after the concrete foundation has formed which is time consuming. Furthermore, the sturdiness of the stakes is dependent on the ground which it is driven in.

In the preferred configurations, the internal bracing member 50 connects to the insulated base member 10 by having a lower portion 51 of the internal bracing member fit into the perimeter recess 13 of the (optionally insulating) base member as shown in FIG. 5 for example.

Figure 8:
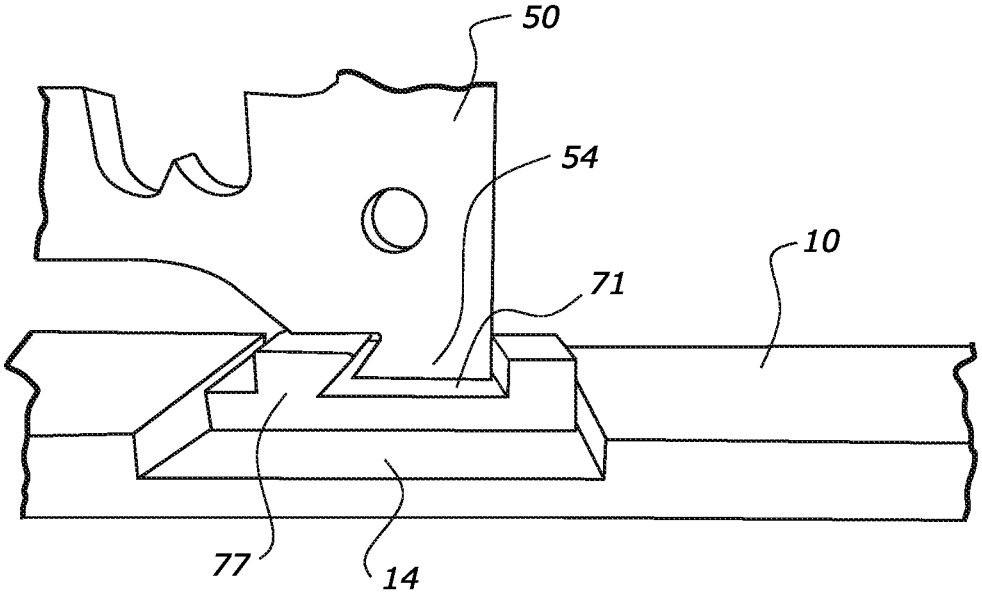
FIG. 8 shows a side view of an inner cradle strip and an internal bracing member.

In some configurations, another lower portion 54 of the internal bracing member 50 fits into an inner recess 14 of the insulated base member as shown in FIG. 8.

As the internal bracing members 50 are supported by the insulated base member 10 (and are not inserted into a ground surface), the effectiveness of the internal bracing members 50 are not dependent on the ground surrounding the concrete foundation.

Features which allow the internal bracing members 50 to connect to components of the formwork 1 are also beneficial as it allows for speed of assembly.

In the preferred configurations, the internal bracing member 50 is coupled to an upper region 42 of the outer board to provide support against tipping once the concrete has been poured as shown in FIGS. 4 and 5.

In the preferred configurations, the components of the formwork 1 are mechanically coupled together.

In the preferred configurations, the internal components are mechanically coupled to the outer board 40.

The components can be mechanically coupled together by a person physically fitting the two components together. The components (e.g. an internal component and the outer board 40) can fit together by inserting, hooking, sliding, wedging, interlocking (or similar actions) components together so that they engage.

Preferably, the components engage in a manner which makes the components easily removable if adhesive has not been applied to the joining region. However, the components are self-supporting when coupled, so that components remain upright/in place during assembly/before receiving concrete.

Preferably, the components are coupled together in a direction which provides limited resistance (e.g. it is easy to insert a component downwardly), but results in a very strong joint in another direction (e.g. the component cannot move sideways easy due to the pressure of concrete).

Preferably, the internal components and the outer board 40 can fit together with no or minimal tools. This will allow the internally braced permanent formwork 1 to be constructed simply and rapidly, thus reducing the time and/or skill level required to assemble the formwork and saving the time required.

Preferably, the internal component and the outer board 40 have complementary features which are configured to fit together.

In some configurations, the complementary features are complementary protrusions and apertures. It is anticipated, that in other configurations, the outer board and internal components have other complementary features which engage and hold the components together.

One configuration of internal bracing members 50 (an internal component) coupled to the outer board 40 which will now be described, is shown in FIGS. 4, 5, and 7. It is anticipated that the outer board 40 can be coupled to another internal component (such as a modified void former, inner form board etc.) in a similar manner.

In this configuration, the outer board 40 comprises a feature which can be connected to the internal bracing member 50. The outer board 40 comprises a shelf member 80.

The shelf member 80 may be manufactured (e.g. extruded) with the wall of the outer board, coupled to the board wall at a later stage, or formed by a method know by a skilled person in the art.

In this configuration, the shelf member 80 comprises one or more apertures 81 to receive an upward protrusion 52 of the internal component/internal bracing member The protrusion 52 is a portion of the internal bracing member 50 which protrudes from its body 2 to mate with a feature of the shelf member 80 (such as apertures).

In some configurations, the shelf member 80 have a plurality of apertures 81 spaced along its length as shown in FIG. 47. The apertures 81 in the shelf member 80 may provide predefined locations for the internal component/internal bracing members 50 to connect to, so that when a worker goes to assemble the formwork 1, they can simply fit the internal bracing members at the apertures with minimal or no further measurements.

In the preferred configurations, the spacing between internal bracing members is between 300 mm and 1200 mm.

In the most preferred configurations, the spacing between internal bracing members is between 450 mm and 700 mm.

The apertures 81 may be of any shape including circular (FIG. 5), semi-circular (FIG. 4), rectangular etc. Preferably, the shape of the apertures 81 is capable of receiving a corresponding feature of the internal bracing member 50, and maintain its position.

In some configurations, the shelf member 80 may be adhered to the outer board 40 as shown in FIG. 4.

In other configurations, the shelf member 80 is mechanically coupled to the outer board 40. In some configurations as shown in FIG. 5, the shelf member 80 comprises a protruding feature 82 which is mechanically coupled to a recess 43 in the outer board 40.

In some configurations, the internal bracing member 50 hooks or wedges itself onto the outer board 40. In some configurations, the internal bracing member 50 hooks onto a feature of the outer board 40 (e.g. a top edge of the board, or a protruding feature on an inner side wall).

Bracing Member Profile

In one preferred configuration of the present invention, as shown in FIG. 5, the internal bracing members 50 are hollow members. These internal bracing members have a hollowed out centre region 55 which allows concrete to flow through (and rebar 21). A hollow internal bracing member 50 which has a rigid frame and a hollowed centre 55 provides the strength and support required for the formwork 1, while having minimal disturbance to the formation of concrete around the footing region 2. It will be appreciated that having reinforcing bar laid through the hollow middle sections, will also help a whole the bracing members down due to the weight of the reinforcing bar.

In some configurations, the internal bracing members 50 the lower portion 51 are legs. The legs 51, 54 of the internal bracing member 50 space the bottom edge of the bracing member from the insulated base member 10, allowing the concrete to flow beneath the member. The legs of the internal bracing member 50 are protruding members which can also allow easy coupling between the internal bracing member and the insulated base member 10.

In one configuration, the internal bracing members 50 comprise a first leg 51 configured to be inserted into a perimeter recess 13 and a second leg 54 configured to be inserted into an inner recess 14 spaced inward from the perimeter recess, as shown in FIG. 4. This configuration of the internal bracing member 50 coupled to the recesses 13, 14 in the insulated base member 10 allows the bracing member to be securely supported by the base member.

Figure 10:
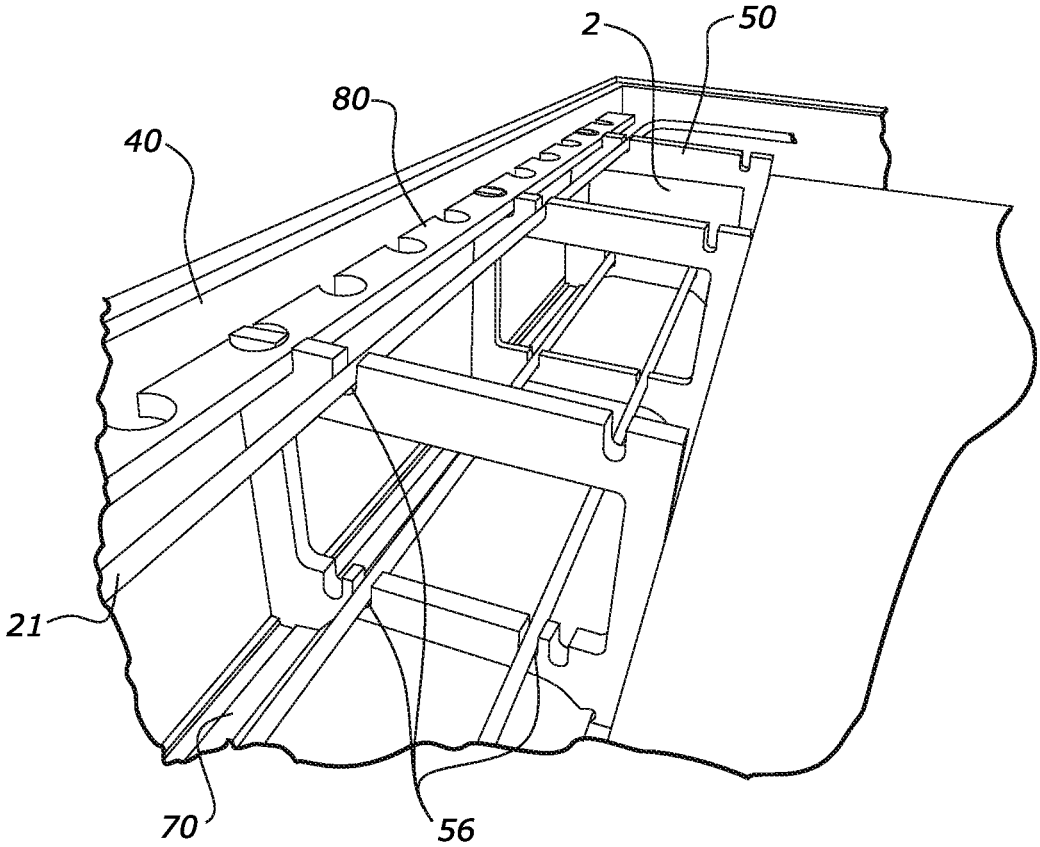
FIG. 10 shows a perspective view of the formwork including rebar.

In the preferred configurations, the internal bracing members 50 comprise integrated reinforcing (rebar) chairs 56 configured to receive and locate rebar 21, as shown in FIGS. 5 and 10. The rebar chairs 56 are sized and profile to receive the rebar 21 which in turns reinforces the concrete. The size and profile of the rebar chairs 56 preferably maintains the position of the rebar 21 and limit movement of the system.

Optionally, a cap (not shown) is provided over the rebar chair 56 to keep the rebar 21 within the rebar chair.

Preferably the rebar 21 is supported onto a plurality of internal bracing members 50. An advantage of placing rebar 21 onto a plurality of internal bracing members 50 is that it stabilises the bracing members and in turn the formwork. As the rebar 21 braces the internal bracing members 50, they are less likely to move or fall over. It will be appreciated that wire ties, or other similar fixings may be utilised to join components as is generally known in the industry. As the internal bracing members 50 are more stable, the outer boards 40 in turn will be well supported against the pressure of wet concrete.

The rebar chairs 56 may be are located on the upper surface of the horizontal members of the internal bracing members 50, or lower members, or both.

In some configurations, separate traditional rebar chairs are installed within the formwork 1 to supplement the rebar chairs 56 on the bracing members, or used instead of them.

In some configurations, rebar chairs 56 are present on other internal components of the formwork 1.

Optionally, the internal bracing members 50 have one or more apertures 57 through the body of the member as referenced in FIG. 5. These apertures 57 allow wet concrete to flow through. Allowing concrete to pass through, limits the likelihood of wet concrete pushing the internal bracing member 50 over when the concrete is being poured. Furthermore, as the concrete is cured through the internal bracing members the concrete may keep the internal bracing member in place and limit movement, therefore providing a reliable and stable system.

In some configurations, the apertures 57 may not be present in the internal bracing members 50.

In the preferred configurations, the internal bracing members 50 are generally flat. The thickness of the internal bracing members 50 is preferably between 10 mm and 60 mm.

This flat configuration of the internal bracing members 50 may be advantageous as the bracing members can be flat-packed and easy transported. The flat configuration may also be beneficial as they are easy to manufacture. For example, the internal bracing members may be formed from a board with sections cut out to form the desired profile. Additionally, the flat configuration of the internal bracing members 50 may also be beneficial and it minimises the interference of the bracing member as the concrete is poured into the formwork and the concrete cures.

In some configurations, the components of the formwork system 1 can be packaged as one or more flatpack bundles. This is advantage as the components will be easy to transport as required.

In some configurations, the internal bracing member 50 comprises plastic, PVC foam board or metal. It is anticipated any other material with suitable physical characteristics such as strength and durability may be used.

The internal bracing members 50 may be formed by cutting boards to form suitable shapes (e.g. using a CNC machine or manual router), injection moulding or any other suitable known techniques in the art.

It is anticipated that the internal bracing members 50 are not limited to the illustrated configurations (which show independent bracing members). In some configurations, the internal bracing member 50 is a multifunctional member, integrated with another component of the formwork 1, such as a void former 90, or the base member 10.

Figure 21A:
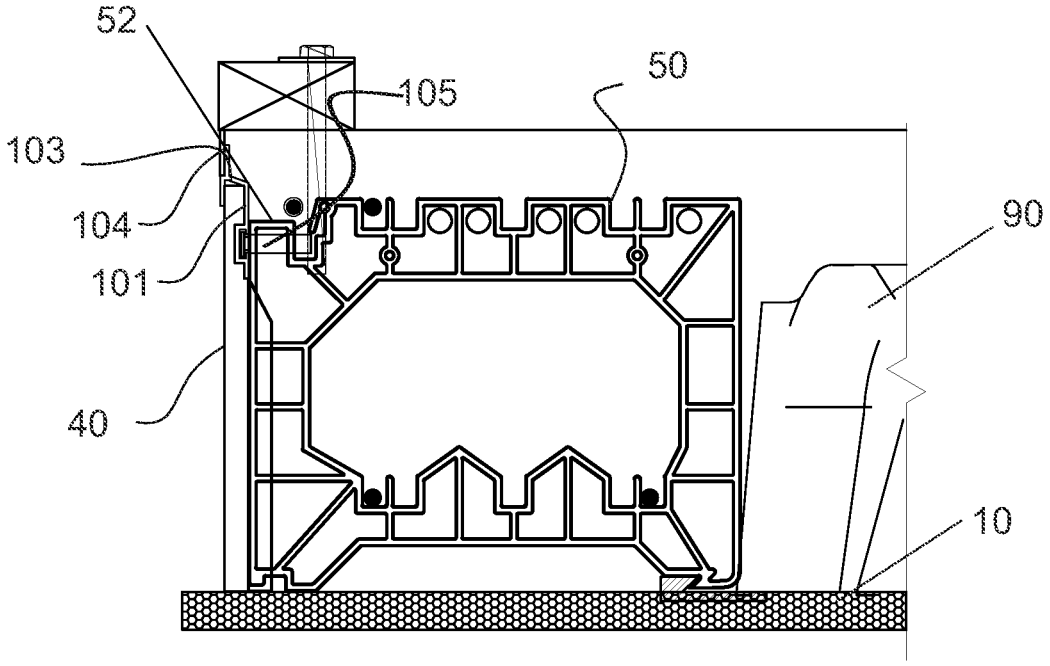
FIG. 21A shows a cross-section view of an alternative configuration for a 90 mm bottom plate.
Figure 21B:
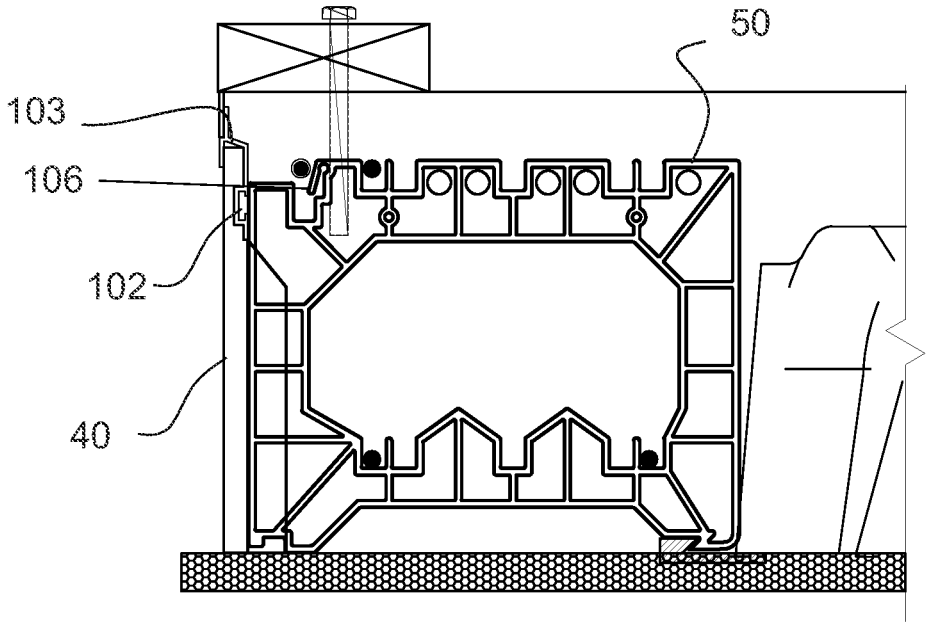
FIG. 21B shows a cross-section view of an alternative configuration for a 140 mm bottom plate.
Figure 22A:
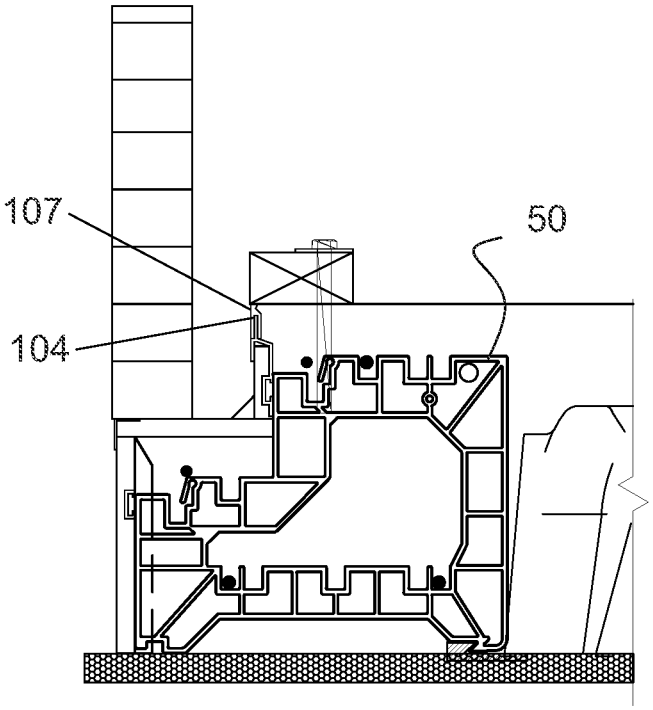
FIG. 22A shows a cross-section view of an alternative stepped configuration for a 90 mm bottom plate.
Figure 22B:
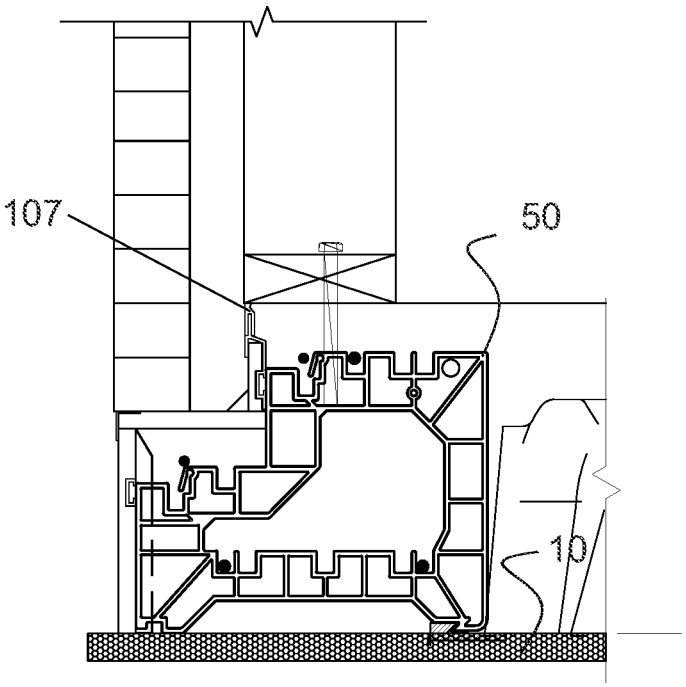
FIG. 22B shows a cross-section view of an alternative stepped configuration for a mm bottom plate.

With particular reference to FIGS. 21 & 22, a further preferred configuration is shown. In this configuration, the interface between bracing members 50 and outer board 40 is different. In this configuration, the outer board 40 has a profile member 101 incorporated.

The profile member 101 is shown in cross-section in FIG. 23, and comprises an upper to 104, a key slot 102 and board recess 103.

As an assembly, the profile member 101 is bonded to the upper region of outer board member 40. It will be appreciated that board recess 103 is sized and shaped to firmly receive the upper edge of board member 40, to firmly hold the components together. Preferably the profile 101 is additionally bonded to outer board member 40 by a suitable adhesive and/or forming process.

In the most preferred embodiments, profile member 101 achieves a number of advantages.

For example, instead of the previously described continuous shelf member 80 and aperture 81 arrangement, the profile 101 provides an elongate key slot 102 for attachment to internal bracing members 50. For this purpose, a number of eyelets 105 are slidably engaged with key slot 102 during construction, in lieu of a continuous shelf member 80. That is, a construction worker simply slides a number of eyelets 105 into the slot 102 adequate to achieve a preferred spacing. Once engaged, eyelets 105 can be easily moved laterally along key slot 102, to provide discrete shelf members 80, but are prevented from being pulled out of key slot 102, thus providing a strong engagement point for respective bracing members 50 (as illustrated in FIG. 23).

Further, it is anticipated that additional eyelets 105 may be added to provide anchor point for joining to other foundation elements. For example, wire ties coupled to existing or additional eyelets (at any desired spacing), may be used to fix to the reinforcing (mesh and/or reinforcing bar).

An example eyelet form is illustrated in FIG. 24, but it will be appreciated that many different forms may be possible. Eyelets 105 running in key slot 102, provide an alternative arrangement for providing apertures 81 with which bracing members 50 interlock with outer board members 40 (via protrusion 52). This improved configuration may have the advantage of being a more easily manufactured and/or integrated into the system.

Where bracing members 50 are extruded for example, eyelets 105 may be extruded at the same time in the same die. For example, eyelets may be extruded in such a way that they can be simply snapped off the bracing members 50 when ready to assemble.

In addition, a locking member may be provided as part of bracing member 50 in order to lock eyelets 105 together with the bracing members once pushed into position. As shown in FIG. 21B (shown without eyelet for clarity), a living hinge flexible member 106 may be provided, such that when eyelet 105 is engaged, flexible member 106 prevents removal (as shown in FIG. 21A). This feature, if included helps to keep the formwork in position as it is constructed.

As an additional benefit, it will be appreciated that profile 101 may provide additional rigidity to outer boards 40 as described previously. That is, the preferred embodiment, profile 101 may be constructed of extruded aluminium (or other suitable material) which is bonded to outer board 40. For this purpose, it may be helpful to include a rough surface on the inside of profile 101 to improve adhesive bonding.

A further benefit of the shape of profile 101 comes from the upper tip 104. As shown in FIGS. 22A&B (stepped slab for brick cladding), the upper tip 104 provides a firm edge for accurate screeding of the top layer of the concrete foundation. However, it is also envisaged that additional height adjusting members 107 may be utilised to alter the thickness of the foundation slab, (and in particular the top layer of a waffle foundation).

As shown in FIG. 22, height adjusting members 107 may be placed on top of tip 104, thereby altering the final height of the formwork. This feature provides an easy ability to thicken the slab where desired. For example, the strength of a garage floor may be required to be higher than a standard residential floor. The addition of height adjusting members 107 allow a quick and easy method of engaging with tip 104 in order to thicken the slab, without requiring any modifications or different sizes to other components in the formwork system.

Formwork with Step

FIGS. 1 to 11 show an internally braced permanent formwork fora rectangular foundation construction with uniform height. It is anticipated that the internally braced permanent formwork 1 can be modified to achieve concrete foundations with different profiles or characteristic requirements.

Another configuration of the present invention as shown in FIGS. 11 to 14 will now be described. In this configuration, the internally braced permanent formwork 200 comprises a stepped region 201 in the footing.

Figure 12:
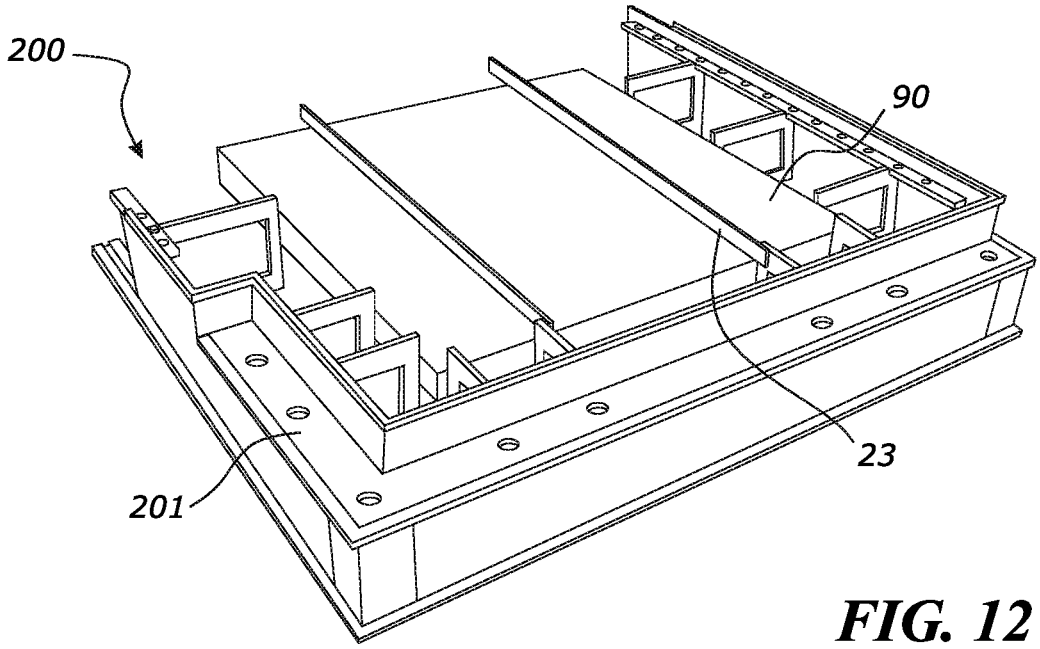
FIG. 12 shows a perspective view of the formwork with a stepped footing.

The stepped region 201 is a section in the footing which has a reduced height in comparison to the remainder of the footing region as illustrated in FIG. 12. A stepped region 201 may be used to receive brick (or other) cladding.

Preferably, in this configuration, the formwork 1 comprises intermediate boards 202 to form a stepped foot region.

Figure 13:
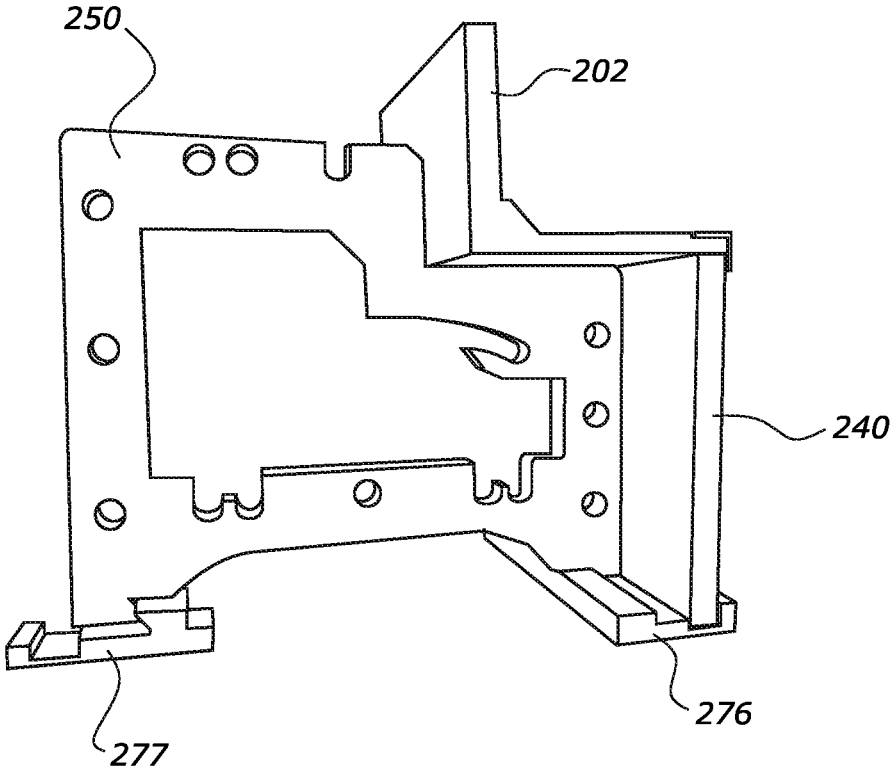
FIG. 13 shows a side view of an internal bracing member for the stepped footing.
Figure 14:
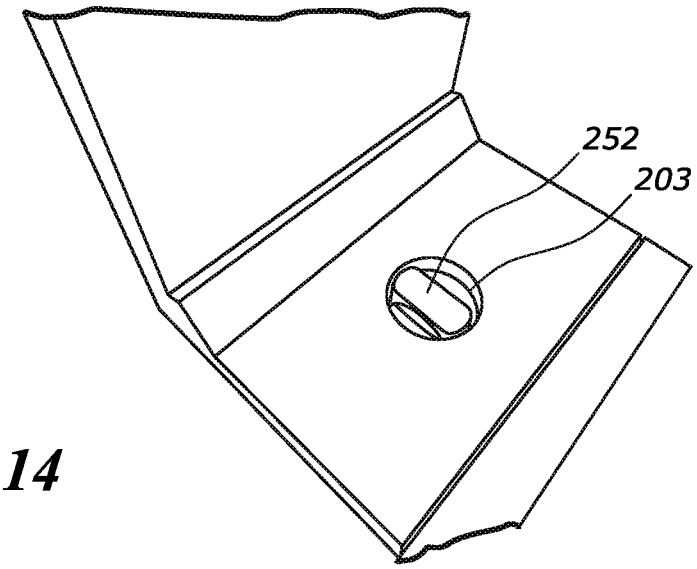
FIG. 14 shows a top view of a connection of the internal bracing member for the stepped footing.

FIG. 13 shows one configuration of an internal bracing member 250 used in the stepped region 201 of the footing. The shape of the internal bracing member 250 corresponds with the shape of the outer boards 202, 240 which forms the shape of the stepped region 201.

Preferably, in this configuration, the internal bracing member 250 comprises a stepped region in an upper corner. The board at the stepped region 202 is supported by the internal bracing member 250.

Preferably, the internal bracing member 250 is connected to the outer board. Preferably, the internal bracing member 250 has a feature which corresponds to the board 202.

In one configuration, the board at the stepped region 202 comprises an aperture 203 which receives a protruding tab 252 of the internal bracing member 250.

In some configurations, the stepped internal bracing member 250 comprises a rebar chair below the stepped region 202. The rebar chair is configured to receive rebar and strength this area as heavy load may be applied to this region.

In some configurations, the stepped internal bracing member is received in a perimeter cradle strip 276 and inner cradle strip 277.

Stepped Slab

It is also anticipated that the present system lends itself to easily forming a stepped slap. Stepped slabs are common where a building design calls for different floor levels, and these are typically achieved by overlapping adjacent slabs in a small area to form a double thick overlapping region.

Figure 25:
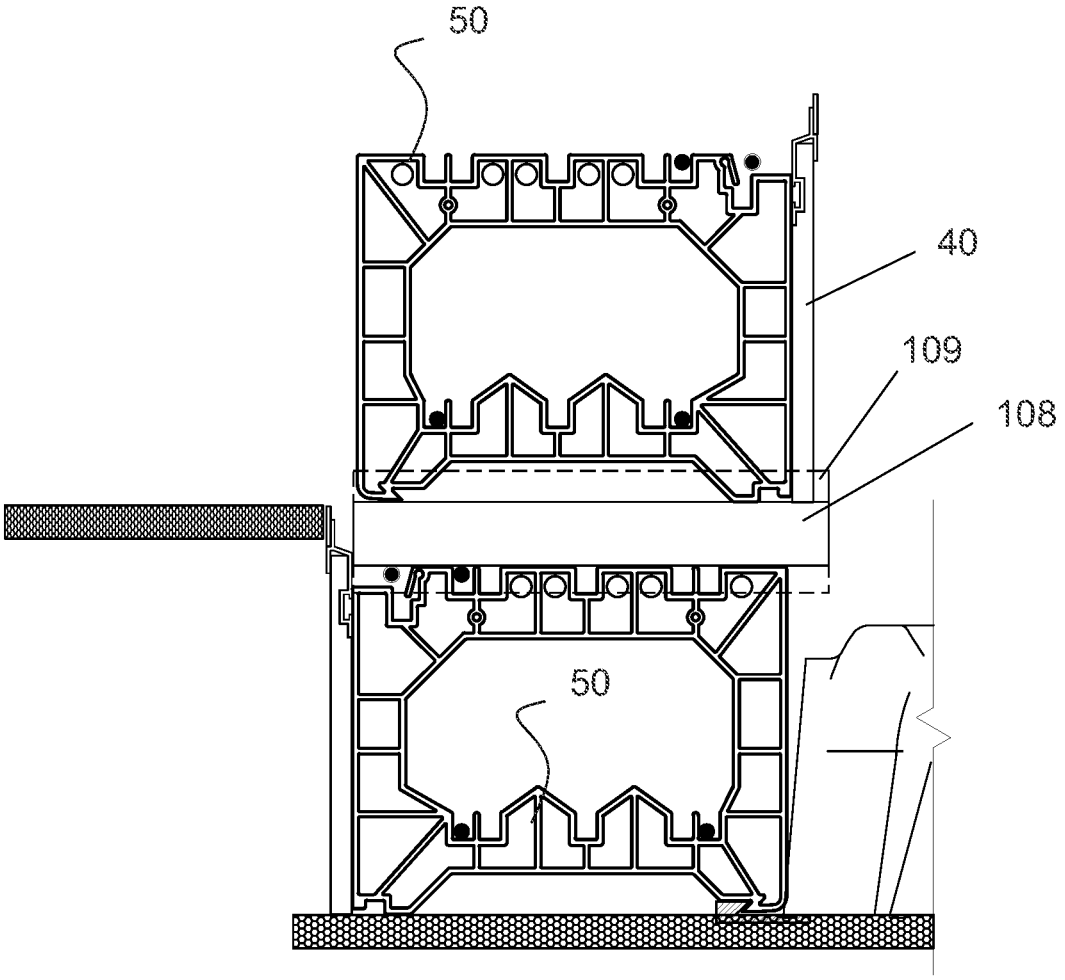
FIG. 25 shows a simplified cross-section view of a stepped slab formwork.

With reference to FIG. 25, spacers 108 are illustrated. Spacers 108 have slots (shown in broken lines) on the top and bottom of each edge adapted for mating with upper and lower bracing members 50. As shown in FIG. 25, the spacers 108 allow bracing members 50 to sit on top of one another to form a double thick overlapping slab. An additional lip 109 is provided in order to engage with a bottom edge of the upper outer board 40 to hold it in place against the pressure of wet concrete.

Void Formers

In the preferred configurations, the internally braced permanent slab formwork 1 may further comprises one or more void formers 90 as best illustrated in FIGS. 12 and 15.

In the preferred configurations, multiple void formers 90 are installed within the space formed by the formwork 1 as shown in FIG. 15. In the preferred configurations, the void formers 90 are located internally relative to the footing region 2.

In some configurations, where there are no void formers 90, the space formed by the formwork 1 is filled with concrete.

Alternatively, void formers are incorporated into the concrete foundation. The benefits of including void formers into concrete foundation include reducing associated costs as they fill up space which would otherwise require concrete (and components for concrete reinforcement). Void formers may also improve the concrete foundation's insulating properties, and this type of slab is often called a waffle slab In some configurations as shown in FIG. 12, the void former 90 is a block member.

In some configurations, the void former blocks 90 are arranged to form a waffle pod system, where concrete sets between the pods and present a 'waffle' concrete profile within the formwork.

In some configurations, the void formers are formed from polystyrene. In other configurations, they are formed from plastic, cardboard or other suitable materials. In other configurations as illustrated in FIGS. 15 and 16, the void formers 90 are hollow members with a void 92.

Hollow void formers 90 may be beneficial as air trapped within the hollow sections improve insulating properties of the concrete foundation. In some configurations, the hollow sections may be used as a pathway for airflow. In other configurations, the hollow sections may be used for a pathway for waterflow or as space for water storage.

The void formers 90 may be formed from cardboard, plastic, polystyrene or any other suitable materials.

In one configuration, hollow void formers 90 are formed from honeycomb card-board. Honeycomb cardboard provides a rigid structure, which can be easily manufactured, and is a recyclable material.

It is anticipated that any other void forming structures known by a skilled person in the art may be installed within the formwork 1. The described present invention is compatible with existing void formers.

In some configurations, the void formers 90 are between 800 mm×800 mm and 1300 mm×1300 mm.

In some configurations, the void formers 90 are 1100 mm×1100 mm.

It is anticipated that the dimensions of the components in the formwork system 1 may be adjusted to be compatible with different concrete slab components used by a person skilled in the art.

In the preferred configurations, the void former 90 is connected to the insulated base member 10 as shown in FIG. 16. Preferably, the inner recesses 14 in the insulated base member 10 are configured to receive at least a segment of a hollow void former 90. Preferably, an inner cradle 77 comprises an inner slot 71 configured to receive an internal bracing member 50 and the void former 90.

In other configurations, the inner cradle 77 comprises an inner slot 71 configured to receive the internal bracing member 50, but not a void former 90 (as shown in FIG. 8).

Preferably, the pod 90 comprises a feature which engages in the inner recess 14 of the insulated base member 10.

In one configuration, a lower edge 91 of the void former 90 engages in the inner recess 14 of the insulated base member 10. Preferably, the lower edge 91 of the void former 90 directly or indirectly engages with the inner recess 14.

In some configurations, as shown in FIGS. 15 and 16, the void former 90 engages indirectly in the inner recess 14 via an inner cradle member 77.

In other configurations, the void former 90 engages directly in the inner recess 14 of the insulated base member.

It is anticipated that the void former may be single function member, or a multi-functional member integrated with another component such as the insulated base member 10, and/or the internal bracing member 50.

Method of Assembly

Following the general description of the structure of the present invention described above, a description of the method of assembly of the permanent formwork 1 will now be described.

The structure of the present invention is configured to be assembled together simply and quickly. A simple assembly reduces the time required to put the formwork 1 together and therefore reduce associated labour costs. Furthermore, a quick assembly increases the likelihood of suitable concrete pouring days, as the formwork 1 setup and pour may fit into shorter windows of good weather. This is significant, as many aspects of building construction and on-site days are dependent on weather.

Furthermore, a simple build may be beneficial as the skill level required to assemble the formwork will be lower than more complex assembly processes. Less experienced workers (and therefore cheaper labour) may be involved in the assembly of the components in the present invention.

Additionally, the formwork 1 is configured to be permanent and will not removed after the concrete has set. This will save labour and transportation costs associated with traditional concrete slab construction where the outer formwork and external stakes are removed and transported away.

The formwork 1 of the present invention is quick to assemble due to a combination of useful features.

Preferably, the components are assembled in a 'top-down' manner. Preferably, complementary component features fit together easily in a substantially vertical direction (such as inserting or removing the outer board 40 from the insulated base member 10). However, the features resist motion in a substantially horizontal direction e.g. in the direction the wet concrete is pushing).

Many components in the formwork 1 are mechanically coupled together. Many connecting components have complimentary features which engage with each other. Due to the way components are fit together, minimal tools are required to assemble the formwork 1. The formwork 1 is designed to reduce surveying requirements as components are configured to fit together at predetermined locations.

The formwork 1 can be partially or fully prefabricated in preparation for receiving concrete as discussed above. Prefabricated components also speed up the process of preparing the formwork, and reduces the labour time on-site.

Many of the components of the internally braced permanent formwork 1 are integrated into the final concrete foundation (components are not removed once the concrete has set). This feature of the present invention is beneficial as it reduces associated time and labour costs. Traditionally, the formwork used to contain the concrete is removed and reused.

To form the internally braced permanent formwork 1 components are assembled together at some stage between the manufacturers and the final site for the concrete foundation. Some or all the components may be preassembled before reaching the construction site. A kit of the components may be provided and some or all of the components may be assembled on-site.

To start constructing the internally braced permanent formwork 1, the (optionally) insulated base member 10 is provided. Preferably, the base member is placed on a surface (such as where the concrete foundation will be located) so that its one or more recesses faces upwards as shown in FIG. 2. Preferably, the insulated base member 10 spans at least across the footing region 2. Has been found that the weight of the concrete (combined with other connections between reinforcing bar and meshes etc), are sufficient to hold the base member in place against the pressure of wet concrete.

The formwork 1 is be transported to or assembled on the desired site. The ground may be prepared by methods known in the art such as compacting a sandy, gravelly soil for example.

The recesses 13, 14 on the insulated base member 10 can be formed by routing grooves onto the upper surface 12. The recesses 13, 14 can be formed by machinery (CNC machine) or tools either on-site or off-site as illustrated in FIG. 3. In some configurations, the base member 10 is manufactured with recesses 13, 14 (e.g. using 3D printing or an extrusion process).

The method of creating the recesses 13, 14 may be dependent on the material. For example recesses may be cut into a polystyrene (or similar) base member 10, or recesses may be directly extruded in a base member comprising a more rigid material.

It is anticipated that other methods of creating the recesses 13, 14 known by a person skilled in the art may be used.

To form the outer periphery, the permanent outer boards 40 are inserted into the perimeter recesses 13 of the insulated base member so that a lower edge 41 of the outer board engages in the recess. This ensures that the lower portion of the outer board is secured against the weight of the concrete.

Figure 17A:
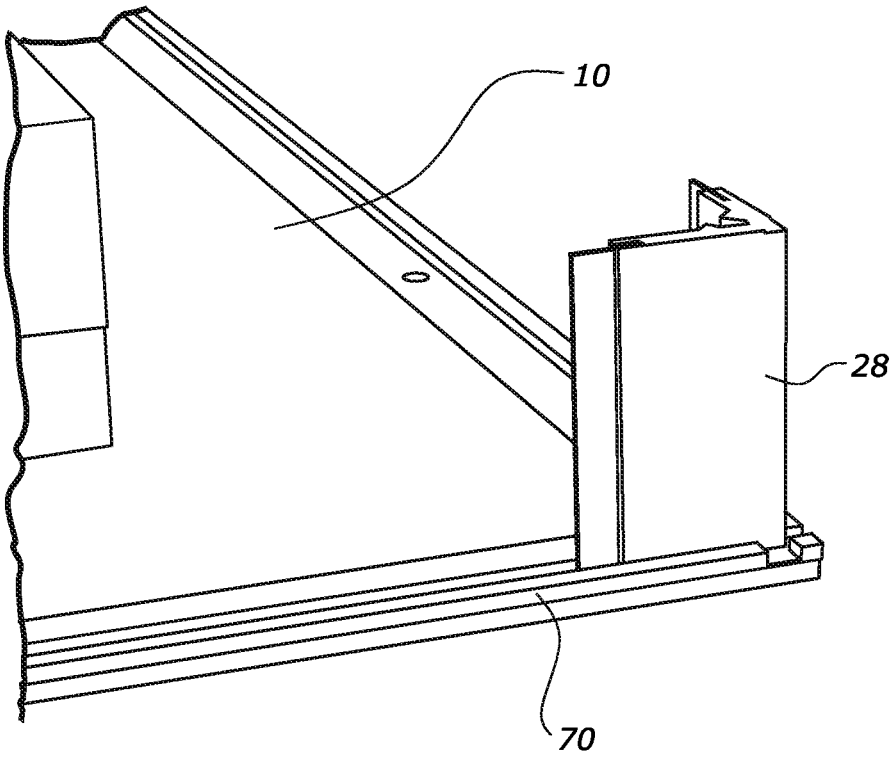
FIG. 17A shows a perspective view of a corner plate in the formwork.
Figure 17B:
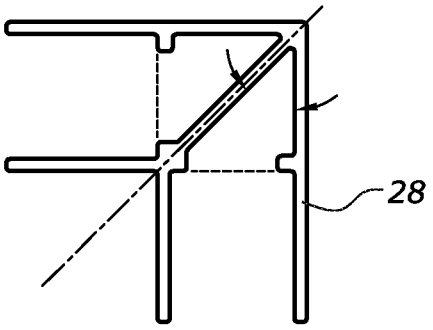
FIG. 17B shows a cross sectional view of an alternative corner joiner.

Optionally, a corner plate 28 can be included into the formwork 1 as shown in FIG. 17A. The corner plate 28 may further support the outer boards 40 against the pressure of the concrete. It is anticipated that different design corner plates may be constructed to deal with different desired angles, however the most common angle between boards at a corner is 90°. An example of an alternative corner joiner is shown in FIG. 17B Securing the upper region 42 of the outer board 40 against the weight of the concrete is also important.

Preferably, in addition to securing the lower portion of the outer board, the upper region of the outer board 40 is coupled to an internal component of the formwork 1.

In some configurations, a plurality of internal bracing members 50 are installed to maintain the structure integrity of the outer boards. Preferably, the outer boards 40 are coupled to the internal bracing members 50. In some configurations, a lower portion 51 of the internal bracing member fits into the perimeter recess 13 of the insulated base member 10.

In other configurations, the outer boards 40 are coupled to the void formers 90.

In other configurations, the outer boards 40 are coupled to another internal component of the internally braced permanent formwork 1.

In some configurations, one or more cradle strips 76, 77 are inserted into the recesses to receive components of the formwork 1.

In some configurations one or more components of the formwork 1 are inserted into an inner slot 71 of the cradle strip 76, 77. Preferably, the inner slot 71 receives a component such as the outer board 40 or internal bracing member 50 to keep it upright.

Preferably, the inner slot 71 is sized and profiled to receive a lower end of a component (e.g. leg 54) of the component. In the preferred configurations, the component is inserted in a generally downward direction, and may need to be inserted at an angle to fit into the inner slot 71 (FIG. 8).

In one configuration, the outer board 40 and the internal bracing member 50 is inserted into the same perimeter recess 13.

Once the outer board 40 has been inserted into the base member 10, the outer board can be coupled to an internal component by fitting complementary features of the outer board and the other component together.

In the configuration shown in FIGS. 7 & 22, a protrusion 52 on the internal bracing member 50 is coupled to the aperture 81 of an intermediate shelf member, so that the internal bracing member 50 and the outer board 10 are mechanically coupled together. If adhesive has not been applied, the internal bracing member 50 may be easily uncoupled.

In some configurations, complementary features between components of the formwork 1, form a dovetail joint as shown in FIG. 7, or a key slot as shown in FIG. 24. In some configurations, to form the outer board 40, a protruding feature of the shelf member 80 is inserted into a side recess on the outer board 40 sidewall.

In other configurations, the internal bracing member 50 or another internal component may fit with the outer board 40 directly.

In further alternatives, for example those illustrated in FIG. 22, a profile member 101 may be provided to integrate a feature such as key slot 102, into outer board member 40.

In some configurations, void formers 90 are installed within the formwork 1.

To reinforce the concrete, preferably rebar is installed. In some configurations, the rebar is installed onto the rebar chairs 56 of the internal bracing member 50.

To further reinforce the concrete, a mesh reinforcement such as a top steel mesh 22 can be installed.

Optionally, a mesh separator 23 can be placed prior to the steel mesh, so that the mesh is spaced from some of the other components.

Optionally, some of the components are tied together with ties 24 as referenced in FIG. 11. Ties may be used to provide extra rigidity and limit movement between components and/or help align components by pulling them together.

In some configurations, the formwork 1 comprises ties connecting the mesh reinforcement 22 and the outer boards 40 together.

In some configurations, as the tie is tightened, the outer board 40 and mesh reinforcement 22 is brought closer together.

Use of ties 24 in the system may be advantageous as they may be used to adjust positioning of components during assembly.

Suitable ties known in the art may be used. For example, zip ties, release ties, wires or similar may be used.

In some configurations, the tie connects the internal bracing member 50 and another component of the formwork 1.

Finally, the concrete is preferably poured into a space defined by the outer boards 40.

Measurements

It is anticipated that the components are sized and profiled as required for different size and shaped concrete foundations.

In some configurations, the concrete foundation is typically 100 mm to 600 mm deep.

Preferably, the concrete foundation is between 200 mm and 400 mm deep.

In some configurations the recesses 13, 14 comprise a depth between 5 mm and 20 mm.

In some configurations the recesses 13, 14 comprise a width between 40 mm and 100 mm.

Preferably, the recesses 13, 14 comprise a width between 40 mm and 60 mm Preferably, the recesses 13, 14 are spaced 5 mm to 10 mm from the base of the insulated base sheet.

In the preferred configurations, the permanent outer boards 40 are 10 to 30 mm thick. In some configurations, thicker permanent outer boards may be used.

In some configurations, the rebar 21 has a diameter between 12 mm to 18 mm.

In some configurations, a 200 mm×200 mm spaced steel mesh is used as mesh reinforcement 22.

To those skilled in the art to which the invention relates, many changes in construction and widely differing embodiments and applications of the invention will suggest themselves without departing from the scope of the invention as defined in the appended claims.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention claimed is:

1. An internally braced permanent formwork for concrete slab foundation construction comprising:

a base sheet member directly or indirectly having a perimeter recess on an upper surface of the base sheet member configured to receive components of the formwork, one or more permanent outer boards to receive and contain concrete for a concrete slab foundation and forming an outermost peripheral wall of the slab foundation, a plurality of internal bracing members supporting the outer boards integrated internally into the slab foundation, the internal bracing members are hollow members comprising a hollowed out centre region to allow concrete to flow through and the one or more permanent outer boards are coupled to the internal bracing members at an upper region of the outer boards to provide support against tipping, and wherein the one or more permanent outer boards are connected to the base sheet member so that a lower edge of the outer board engages in the perimeter recess.

2. The internally brace permanent formwork as claimed in claim 1 wherein the base sheet member is located at least around a perimeter of the slab and the perimeter recess extends substantially the length of the base sheet member.

3. The internally braced permanent formwork as claim in claim 1 further comprising an inner recess directly or indirectly on an upper surface of the base sheet member and a first lower portion of the internal bracing members fits into the inner recess of the base sheet member to securely support the internal bracing member.

4. The internally braced permanent formwork as claim in claim 3 wherein the inner recess comprising a complementary hook profile for coupling the first lower portion of the internal bracing members to the base sheet member.

5. The internally braced permanent formwork as claimed in claim 1 wherein the internal bracing member and the outer board have complementary features configured to engage and connect the components.

6. The internally braced permanent formwork as claimed in claim 1 wherein the formwork comprises one or more cradle strips inserted in the perimeter recess and/or an inner recess to receive components of the formwork in the base sheet member indirectly, the one or more cradle strips further comprising an inner slot configured to receive one or more components of the formwork.

7. The internally braced permanent formwork as claimed in claim 1 wherein the perimeter recess is a slot having a lip configured to secure the one or more permanent outer boards and provide extra resistance against wet concrete.

8. The internally braced permanent formwork as claimed in claim 2 comprising rebar to reinforce the concrete in a footing region, wherein the internal bracing members comprising rebar chairs configured to receive the rebar.

9. The internally braced permanent formwork as claimed in claim 1 further comprising intermediate boards to form a stepped foot region.

10. The internally braced permanent formwork as claimed in claim 1 wherein the permanent outer boards are mechanically coupled to internal components by one or more of actions consisting of:

i. inserting,
ii. hooking,
iii. sliding,
iv. wedging,
v. interlocking.

11. The internally braced permanent formwork as claimed in claim 1 wherein the outer board is an insulated permanent outer board formed from one or more of materials consisting of i. PVC board,
ii. fiberglass,
iii. polymers,
iv. cement board;

and the base member is an insulating member formed from one or more of materials consisting of:

i. polystyrene,
ii. foam,
iii. rubber.

12. The internally braced permanent formwork as claimed in claim 1 wherein the permanent formwork is formed on a ground surface.

13. A method of constructing a concrete slab foundation using an internally braced formwork comprising:

providing a base sheet member having a perimeter recess formed directly or indirectly on an upper surface of the base sheet member configured to receive components of the formwork, inserting one or more permanent outer boards into the perimeter recess of the base sheet member so that a lower edge of the permanent outer board engages in the perimeter recess, the permanent outer boards receive and contain concrete for a concrete slab foundation and forming an outermost peripheral wall of the slab foundation, providing a plurality of internal bracing members to support the permanent outer boards, the internal bracing members are hollow members comprising a hollowed out centre region to allow concrete to flow through, coupling the one or more permanent outer boards to internal bracing members at an upper region of the permanent outer board to provide support against tipping, the one or more permanent outer boards being integrated internally into the slab foundation, and pouring concrete into a space defined by the permanent outer boards.

14. The method of constructing a concrete foundation using an internally braced formwork as claimed in claim 13 wherein one or more components of the formwork are prefabricated off-site, and prefabricated modules of the formwork are preassembled and transported onsite, the prefabricated modules include at least the one or more permanent outer boards, the base sheet member and the internal bracing members.

15. The method of constructing a concrete foundation using an internally braced formwork as claimed in claim 13 including further forming an inner recess directly or indirectly on an upper surface of the base sheet members configured to receive internal components of the formwork and fitting a first lower portion of the internal bracing members into an inner recess of the base sheet member to securely support the internal bracing member wherein the inner recess comprises a complementary hook profile for coupling the first lower portion of the internal bracing members to the base sheet member.

16. The method of constructing a concrete foundation using an internally braced formwork as claimed in claim 13 wherein internal components of the formwork fit into the perimeter recess and/or an inner recess indirectly by inserting one or more cradle strips into the perimeter recess and/or to receive components of the formwork in the base sheet member.

17. The method of constructing a concrete foundation using an internally braced formwork as claimed in claim 15 and further comprising inserting a first leg of the internal bracing members into the perimeter recess and inserting a second leg of the internal bracing members into the inner recess spaced inward from the perimeter recess.

18. The method of constructing a concrete foundation using an internally braced formwork as claimed in claim 13 and further comprising providing ties to tie components together.

19. The internally braced permanent formwork as claimed in claim 1 further comprising a footing region and the base sheet member spans at least across the footing region.

20. The internally braced permanent formwork as claimed in claim 1 wherein the internal bracing members comprise a first leg configured to be inserted into the perimeter recess and a second leg configured to be inserted into an inner recess spaced inward from the perimeter recess.

21. The method of constructing a concrete foundation using an internally braced formwork as claimed in claim 13 further comprising mechanically coupling components of the internally braced formwork together on-site before the concrete is poured, wherein an action of mechanically coupling components is one or more of the actions consisting of:

i. inserting,
ii. hooking,
iii. sliding,
iv. wedging,
v. interlocking.

* * * * *